US007405350B2

(12) United States Patent
Sasaki

(10) Patent No.: US 7,405,350 B2
(45) Date of Patent: Jul. 29, 2008

(54) AUTOMATIC PLAYER MUSICAL INSTRUMENT WITH VELOCITY CONVERSION TABLES SELECTIVELY ACCESSED AND ELECTRONIC SYSTEM USED THEREIN

(75) Inventor: Tsutomu Sasaki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 676 days.

(21) Appl. No.: 11/113,909

(22) Filed: Apr. 25, 2005

(65) Prior Publication Data

US 2006/0000339 A1 Jan. 5, 2006

(30) Foreign Application Priority Data

Jun. 15, 2004 (JP) ..... 2004-177314

(51) Int. Cl.

| | |
|---|---|
| ***G10F 1/02*** | (2006.01) |
| ***G10H 1/02*** | (2006.01) |
| ***G10H 7/00*** | (2006.01) |
| ***G10P 3/00*** | (2006.01) |

(52) U.S. Cl. ..... 84/13; 21/626

(58) Field of Classification Search ..... 84/13, 84/21, 600, 626

See application file for complete search history.

(56) References Cited

U.S. PATENT DOCUMENTS

| | | | | |
|---|---|---|---|---|
| 5,652,399 | A | 7/1997 | Fujiwara et al. | |
| 5,880,393 | A * | 3/1999 | Kaneko et al. | 84/662 |
| 6,403,872 | B2 | 6/2002 | Muramatsu et al. | |
| 7,265,281 | B2 * | 9/2007 | Sasaki et al. | 84/13 |

FOREIGN PATENT DOCUMENTS

| | | |
|---|---|---|
| JP | 7-175472 | 7/1995 |
| JP | 2001-175262 | 6/2001 |

* cited by examiner

*Primary Examiner*—Jeffrey Donels
(74) *Attorney, Agent, or Firm*—Harness, Dickey & Pierce, PLC

(57) ABSTRACT

A key sensor-less automatic player piano includes, key actuators so as to give rise to key motion without any fingering of a human player, key sensors producing key position signals expressing key motion and a data processing unit producing music data codes during a performance on the keyboard and a playback table expressing a relation between the hammer velocity and a reference key velocity; while the data processing unit is recording the performance, the hammer velocity is estimated on the basis of a key velocity-to-hammer velocity conversion table already prepared through an experiment where the keys are depressed by a human player; while the data processing unit is preparing the playback table, the hammer velocity is estimated on the basis of another velocity conversion table prepared through another experiment where the keys are actuated by the key actuators.

20 Claims, 12 Drawing Sheets

| | |
|---|---|
| Velo1 | TIMING T1 |
| Velo2 | TIMING T2 |
| Velo3 | TIMING T3 |
| ⋮ | ⋮ |
| Velo16 | TIMING T16 |

AUTOMATIC PLAYER MUSICAL INSTRUMENT WITH VELOCITY CONVERSION TABLES SELECTIVELY ACCESSED AND ELECTRONIC SYSTEM USED THEREIN

FIELD OF THE INVENTION

This invention relates to an automatic player musical instrument and, more particularly, to an automatic player musical instrument having a recording mode and a playback mode and an electronic system incorporated therein.

DESCRIPTION OF THE RELATED ART

An automatic player piano is a typical example of the automatic player musical instrument. The automatic player piano is a combination between an acoustic piano and an electronically controlled system, and usually has two modes of operation. The first mode of operation is hereinafter referred to as "recording mode", and the second mode is called as "playback mode". While the automatic player piano is staying the recording mode, a user can request the electronically controlled system, which serves as a recorder, to gather pieces of music data for recording the performance on the keyboard and pedals. The recorder encodes the pieces of music data to MIDI (Musical Instrument Digital Interface) music data codes.

On the other hand, when the automatic player piano enters the playback mode, the automatic player piano gets ready to reenact the performance without any fingering of a human player. Upon reception of user's request, the electronically controlled system, which serves as an automatic player, analyzes the MIDI music data codes for reenacting the performance. The automatic player selectively depresses the black and white keys and steps on the pedals for producing the acoustic piano tones along the music passage.

The standard automatic player piano is disclosed in Japanese Patent Application laid-open No. 2001-175262 or P2001-175262A. Japanese Patent Application laid-open No. 2001-175262 was published on the basis of Japanese Patent Application No. Hei. 11-357757, the Priority Right of which had been claimed in U.S. Ser. No. 09/737,615. U.S. Ser. No. 09/737,615 was patented, and U.S. Pat. No. 6,403,872 B2 was assigned to the U.S. Patent. Hammer sensors are installed in the automatic player piano, and form parts of the recorder.

While the user is playing a piece of music on the keyboard and pedals, the hammer sensors monitor the hammers of the acoustic piano, and inform the data processor of the current hammer positions. The data processor analyzes the pieces of hammer data expressing the hammer motion so as to determine the hammer velocity, timing at which the strings are struck with the hammers and so forth and to estimate for timing at which the associated keys are depressed and released. These pieces of music data are stored in a suitable information storage medium for playback. Thus, the pieces of music data are prepared on the basis of the pieces of hammer data.

Another sort of automatic player pianos is not equipped with any hammer sensor, and is, so to speak, a "hammer sensor-less automatic player piano". Such a hammer sensor-less automatic player piano is equipped with key sensors instead of the hammer sensors. The data processor determines the timing at which the black and white keys are depressed and released, and estimates for the hammer velocity and timing at which the strings are struck with the hammers.

The data processor determines the hammer velocity, which is defined in the MIDI protocols as "velocity" on the basis of pieces of key data supplied from the key sensors as follows. The data processor determines a measured value of the reference key velocity on the basis of the pieces of key data. The term "reference key velocity" means the key velocity at a reference key point, and is described in Japanese Patent Application laid-open No. Hei 7-175472. The reference key point is a unique point on the reference key velocity, and the value of key velocity at the reference key point is proportional to the value of hammer velocity immediately before the strike at the string. The value of hammer velocity immediately before the strike at the string is proportional to the loudness of the tone. For this reason, the value of reference key velocity is also proportional to the loudness of tone. In other words, it is possible to control the loudness of tone by adjusting the black and white key to a particular value of reference key velocity.

When the value of reference key velocity is determined on the basis of the pieces of key data, the data processor accesses a table expressing the relation between the reference key velocity and the hammer velocity, and reads out a value of hammer velocity from the table. Thus, the reference key velocity is converted to the hammer velocity, and the value of hammer velocity is encoded into the MIDI music data code expressing the note-on event.

While the automatic player is reenacting the performance expressed by a set of MIDI music data codes, the automatic player analyzes the MIDI music data codes, and determines the black and white keys to be depressed and released, loudness and the timing at which the tones are to be produced. The data processor accesses another table, which will be hereinafter described, with the loudness or a target value of hammer velocity, and reads out a corresponding value of reference key velocity from the table. When the time comes, the data processor starts to control the black and white keys through a servo-control loop so as to make the black and white key to pass the reference key point at the corresponding value of reference key velocity. This results in the target value of hammer velocity, and the tone is produced at the target loudness.

The relation between the reference key velocity and the hammer velocity is determined through an experiment carried out on a master automatic player piano by the manufacturer, and is stored in a suitable non-volatile memory of the recorder. The master automatic player piano is further equipped with the hammer sensors so that the manufacturer can determine the relation between the reference key velocity and the hammer velocity. The table, in which the relation between the reference key velocity and the hammer velocity is defined, is hereinafter referred to as "velocity conversion table".

On the other hand, the table, in which the relation between the target values of hammer velocity and the target values of reference key velocity is stored, is hereinafter referred to as "playback table" for discriminating it from the velocity conversion table. The playback table is prepared on the basis of the velocity conversion table, and the work for preparing the playback table is hereinafter referred to as "study".

The prior art hammer sensor-less automatic player piano studies the relation between the hammer velocity and the reference key velocity as follows: First, the data processor reads out a reference value of the reference key velocity from the information storage medium, and controls the black/white key to pass the reference key point at the reference value. When the black/white key passes the reference key point, the data processor determines a measured value of the key velocity on the basis of the pieces of key data supplied from the associated key sensor, and accesses the velocity conversion table with the measured value of the key velocity at the reference key point, i.e., the reference key velocity. The data processing unit reads out a target value of hammer velocity from the velocity conversion table, and correlates the measured value of the reference key velocity. The data processor repeats the above-described procedure at different reference values of reference key velocity, and the relation between the measured values of reference key velocity and the target values of hammer velocity is tabled as the playback table.

In short, the data processor determines the hammer velocity through the access to the velocity conversion table with the measured value of the reference key velocity in the recording mode, and correlates the measured values of reference key velocity with the read-out target values of hammer velocity through the access to the same data conversion table in the playback mode. Thus, the velocity conversion table is shared between the recorder and the automatic player.

A problem is encountered in the prior art automatic player piano in that the acoustic piano tones are produced in the playback mode at loudness smaller than that expressed in the MIDI music data codes.

SUMMARY OF THE INVENTION

It is therefore an important object of the present invention to provide an automatic player musical instrument, which faithfully reproduces acoustic tones at loudness equal to that expressed in music data codes.

It is also an important object of the present invention to provide an automatic player used in the automatic player musical instrument.

The present inventor contemplated the problem inherent in the prior art automatic player piano, and compared the original key motion, which the human player gave rise to with his or her fingers, with the reproduced key motion, which the solenoid-operated key gave rise to with its plunger. The present inventor found that the reproduced key motion was different from the original key motion. There were various differences between the original key motion and the reproduced key motion. For example, when a human player depressed a key, the key motion was close to uniformly accelerated motion as indicated by plots UA in FIG. 1A; on the other hand, when the solenoid-operated key actuator gave rise to the key motion, the key took the uniform motion as indicated by plots UM in FIG. 1B. While the original key motion was gradually accelerated together with the time, the data processor correlated the key velocity at the reference key point with the hammer velocity, and stored the hammer velocity in the music data code on the assumption that the hammer was brought into collision with the string at the same hammer velocity. Even if the data processor reproduced the hammer motion through the key motion on the assumption that the hammer would take the uniform motion, the final hammer velocity in the playback was less than that in the recording, and, accordingly, the acoustic piano tones were reproduced at loudness smaller than that in the original performance.

The present inventor concluded that the velocity conversion table was to be different between the recording and the study.

In accordance with one aspect of the present invention, there is provided an automatic player musical instrument for producing tones comprising plural manipulators selectively moved for specifying the pitch of tones to be produced, plural link works respectively connected to the plural manipulators and respectively having certain links, the motion of which are given rise to through the motion of the plural manipulators, a tone generator energized with the plural manipulators through the plural link works so as to produce the tones at the pitch specified through the plural manipulators, and an electronic system including plural sensors monitoring the plural manipulators so as to produce signals representative of the motion of the plural manipulators, plural actuators energized with driving signals so as to give rise to the motion of the plural manipulators and a data processing unit connected to the plural sensors and the plural actuators, having a converter expressing a relation between the motion of the plural manipulators and the motion of the certain links determined under the condition that the plural manipulators are moved by a human player and another converter expressing another relation between the motion of the plural manipulators and the motion of the certain links determined under the condition that the plural manipulators are moved by means of the plural actuators and estimating the motion of the certain links and the motion of the plural manipulators on the basis of pieces of data expressed by the signals and pieces of music data expressing the motion of the certain links selectively with assistance of the converter and the aforesaid another converter depending upon an origin of force exerted on the plural manipulators.

In accordance with another aspect of the present invention, there is provided an electronic system used for a musical instrument having plural manipulators, plural link works respectively connected to the plural manipulators and a tone generator energized with the plural manipulators through the plural link works for producing tones, and the electronic system comprises plural sensors monitoring the plural manipulators so as to produce signals representative of motion of the plural manipulators, plural actuators energized with driving signals so as to give rise to the motion of the plural manipulators and a data processing unit connected to the plural sensors and the plural actuators, having a converter expressing a relation between the motion of the plural manipulators and the motion of the certain links determined under the condition that the plural manipulators are moved by a human player and another converter expressing another relation between the motion of the plural manipulators and the motion of the certain links determined under the condition that the plural manipulators are moved by means of the plural actuators and estimating the motion of the certain links and the motion of the plural manipulators on the basis of pieces of data expressed by the signals and pieces of music data representative of the motion of said certain links selectively with assistance of the converter and the aforesaid another converter depending upon an origin of force exerted on the plural manipulators.

BRIEF DESCRIPTION OF THE DRAWINGS

The features and advantages of the automatic player musical instrument and automatic player will be more clearly understood from the following description taken in conjunction with the accompanying drawings, in which.

DESCRIPTION ON THE PREFERRED EMBODIMENT

In the following description, term "front" is indicative of a relative position closer to a player, who is sitting on a stool for fingering, than a relative position modified with term "rear". Term "fore-and-aft" is indicative of a direction parallel to a line drawn between a front position and a corresponding rear position, and term "lateral direction" crosses the fore-and-aft direction at right angle.

Automatic Player Musical Instrument

Figure 1A:
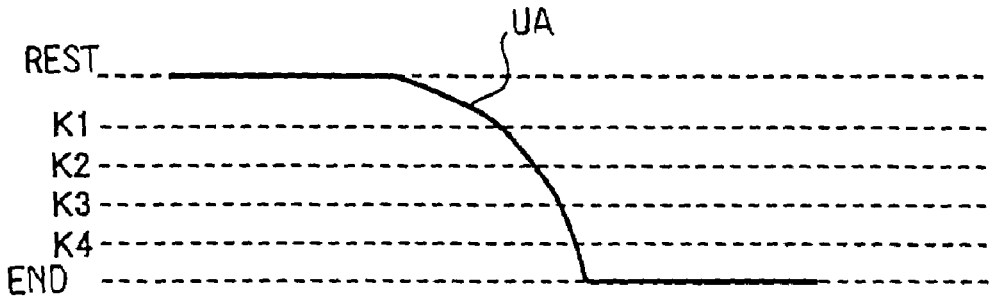
FIG. 1A is a graph showing key motion observed when a human player depressed a key.
Figure 1B:
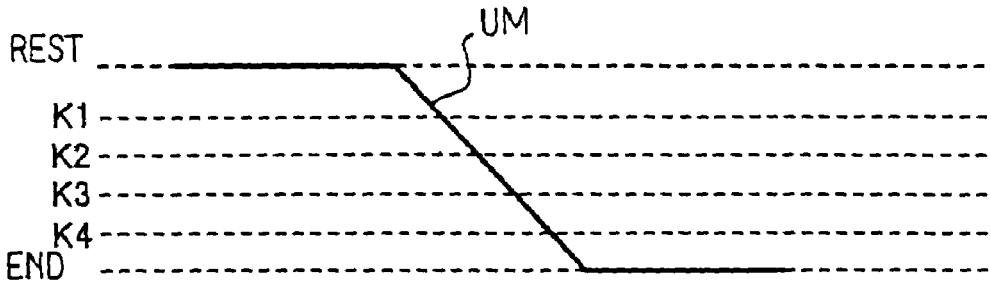
FIG. 1B is a graph showing key motion observed when a solenoid-operated key actuator pushed the key.
Figure 2:
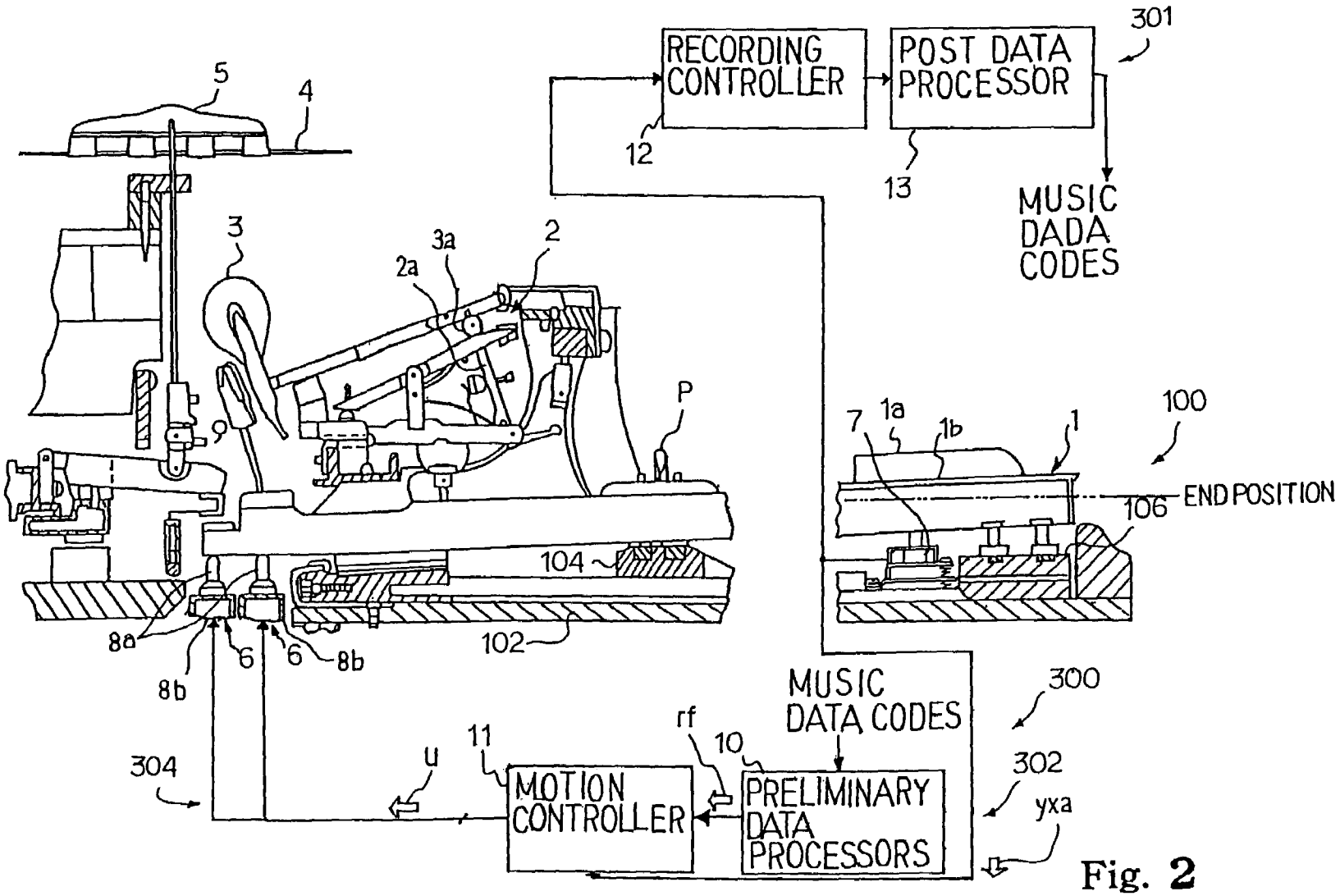
FIG. 2 is a side view showing the structure of an automatic player musical instrument according to the present invention.

Referring to FIG. 2 of the drawings, an automatic player musical instrument embodying the present invention largely comprises an acoustic musical instrument 100 and an electronic system 300, and selectively enters at least a standard mode, a recording mode and a playback mode depending upon user's mode instruction. The acoustic piano 100 is a grand piano, and the electronic system 300 is installed in the acoustic piano 100 so as to serve as a recorder 301 and an automatic player 302.

The user plays a piece of music through fingering on the acoustic piano 100 in the standard mode, and acoustic piano tones are produced through the acoustic piano 100. Thus, the automatic player piano behaves as a standard acoustic piano in the standard mode.

When the user gives the mode instruction for the recording mode to the electronic system 300, the electronic system 300 gets ready to record performance on the acoustic piano 100. While the user is fingering on the acoustic piano 100, the electronic system 300, which serves as the recorder 301, obtains pieces of key data representative of the key motion and pieces of pedal data representative of pedal motion, and analyzes the pieces of key data and pieces of pedal data so as to produce music data codes representative of the acoustic tones produced in the performance on the acoustic piano 100. At least key numbers assigned to the depressed keys, loudness of tones to be produced and time at which the tones are to be produced are memorized in the music data codes representative of note-on events, and at least the key numbers assigned to the released keys are memorized in the music data codes representative of note-off events. The music data codes are supplied to an external data source in a real time fashion, and/or are stored in a memory. Thus, the performance on the acoustic piano 100 is recorded through the electronic system 300 in the recording mode.

On the other hand, the electronic system 300 reenacts the performance, and reproduces the acoustic piano tones through the acoustic piano 100 on the basis of a set of music data codes representative of the performance in the playback mode. The set of music data is read out from a suitable memory. Otherwise, the electronic system 300 requests an external data source (not shown) to transmit the set of music data through a cable or a public communication network. While the music data codes are sequentially being processed, the electronic system 300 determines the pitch, timing at which the acoustic piano tones are to be produced, hammer velocity or loudness, timing at which the acoustic piano tones are to be decayed and effects to be imparted to the acoustic piano tones, if any, along the music passage, and plays the music passage on the acoustic piano 100 without any fingering of a human player.

As will be hereinafter described in detail, two sorts of velocity conversion tables are stored in the electronic system 300. One of the velocity conversion table is used in the recording mode, and is hereinafter referred to as "velocity conversion table for fingered keys". The other velocity conversion table is used in the playback mode, and is hereinafter referred to as "velocity conversion table for solenoid-actuated keys". The velocity conversion table for fingered keys is optimized to the key motion in the recording mode, and the velocity conversion table for solenoid-actuated keys is optimized to the key motion in the playback mode. Thus, the automatic player determines a target value of the hammer velocity through the access to the velocity conversion tables depending upon the mode of operation. This results in a faithful reenactment of a performance.

The velocity conversion table for fingered keys and velocity conversion table for solenoid-actuated keys are prepared by a manufacturer through experiments. The experiments are carried out on a master automatic player piano. The master automatic player piano is similar to the automatic player piano shown in FIG. 2 except hammer sensors. The hammer sensors are arranged as similar to those disclosed in U.S. Pat. No. 6,403,872 B2. For this reason, no further description on the master automatic player piano is herein-after incorporated for the sake of simplicity.

Both hammer and key velocities are determined in the master automatic player piano on the basis of the key position signals, which are output from the key sensors and hammer position signals, which are output through hammer sensors. The hammer sensors monitor final parts of the hammer trajectories immediately before the strings 4. Thus, the velocity conversion table for fingered keys and velocity conversion table for solenoid-actuated keys express the relation between measured values of the reference key velocity, which are determined on the basis of the actual key motion, and measured values of the hammer velocity, which are also determined on the basis of the actual hammer motion.

Acoustic Piano

The acoustic piano 100 includes a keyboard 1, action units 2, hammers 3, strings 4 and dampers 5. The keyboard 1 is mounted on a front portion of a key bed 102, which defines the bottom of a piano cabinet, and the action units 2, hammers 3, strings 4 and dampers 5 are housed in the piano cabinet.

An array of black keys 1*a* and white keys 1*b* is incorporated in the key-board 1. The black keys 1*a* and white keys 1*b* are elongated in the fore-and-aft direction, and are laterally laid on the well-known pattern. In this instance, eighty-eight black and white keys 1*a*/1*b* form the array. The black keys 1*a* and white keys 1*b* pitch on a balance rail 104, and balance pins P keep the black keys 1*a* and white keys 1*b* on the balance rail 104. Front pins guide the black keys 1*a* and white keys 1*b* toward a front rail 106 so that the front portions of black keys 1*a* and front portions of white keys 1*b* reciprocally travel on predetermined trajectories.

The black and white keys 1*a*/1*b* are staying at respective rest positions without any external force exerted on the front portions thereof. The rest positions are located at stroke of zero, and the black keys 1*a* and white keys 1*b* at the rest positions are drawn by real lines in FIG. 2. When the external force is exerted on the front portions of the black and white keys 1*a*/1*b*, the front portions are sunk toward respective end positions. In this instance, the end positions are located at 10 millimeters under the rest positions, and dots-and-dash line is indicative of the upper surfaces of the white keys 1*b* at the end position in FIG. 2.

The black and white keys 1*a*/1*b* are respectively linked at the rear portions thereof with the action units 2, and the action units 2 give rise to free rotation of the hammers 3. The strings 4 are stretched over the hammers 3, and dampers 5 are linked with the rearmost portion of the black and white keys 1*a*/1*b* so as to be spaced from and brought into contact with the strings 4.

While the black and white keys 1*a*/1*b* are staying at the rest positions, the hammers 3 are held in contact at hammer rollers 3*a* thereof with the heads of jacks 2*a*, which form parts of the action units 2, and the dampers 5 are held in contact with the strings 4 as shown in FIG. 2. A pianist is assumed to depress one of the black and white keys 1*a*/1*b*, the depressed key 1*a*/1*b* pitches, and the front portion is sunk toward the end position. The damper 5 is spaced from the string 4 on the way of the depressed key 1*a*/1*b* toward the end position, and permits the strings 4 to vibrate. Moreover, the depressed key 1*a*/1*b* gives rise to the motion of the action unit 2, and the jack 2*a* escapes from the hammer roller 3*a* on the way of the depressed key 1*a*/1*b* toward the end position. Then, the pianist feels the depressed key 1*a*/1*b* lighter than before.

When the jack 2*a* escapes from the hammer roller 3*a*, the hammer 3 starts the free rotation toward the string 4. The hammer 3 is brought into collision with the string 4 at the end of the free rotation, and gives rise to the vibration of the string 4. The string vibrations give rise to the acoustic piano tone at the given pitch.

The hammer 3 rebound on the string 4, and is received by the action unit 2. When the pianist releases the depressed key 1*a*/1*b*, the released key 1*a*/1*b* starts to return toward the rest position. The damper 5 is brought into contact with the vibrating string 4 on the way of the released key 1*a*/1*b* toward the rest position so that the acoustic piano tone is decayed. When the released key 1*a*/1*b* arrives at the rest position, the action unit 2 and hammer 3 return to their rest positions as shown in FIG. 2.

Electronic System

The electronic system 300 serves as the recorder 301 in the recording mode and the automatic player 302 in the playback mode as described herein-before. The function of the recorder 301 is broken down into a recording controller 12 and a post data processor 13. On the other hand, the function of the automatic player 302 is broken down into a preliminary data processor 10 and a motion controller 11. The recording controller 12, post data processor 13, preliminary data processor 10 and a motion controller 11 are realized through a computer program running on a data processing unit 303, the system configuration of which will be hereinlater described with reference to FIG. 3.

The electronic system 300 further includes an array of solenoid-operated key actuators 6, an array of key sensors 7, solenoid-operated pedal actuators (not shown) and pedal sensors (not shown). The plungers and solenoids are labeled with references 8*a* and 8*b*, respectively. A slot is formed in the key bed 102 under the rear portions of the black and white keys 1*a*/1*b*, and is laterally elongated. The solenoid-operated key actuators 6 are hung from the key bed 102, and are laterally arrayed under the rear portions of the black/white keys 1*a*/1*b*. The solenoids 8*b* are disposed in the slot, and the data processing unit 303 is connected to the solenoids 8*b*. The plungers 8*a* are upwardly directed, and the tips of plungers 8*a* are in the proximity of the lower surfaces of the rear portions of the associated black and white keys 1*a*/1*b*. When the data processing unit 303 determines a key 1*a*/1*b* to be moved, the data processing unit 303 supplies a driving pulse signal u to the solenoid 8*b* associated with the key 1*a*/1*b*. Then, the solenoid 8*b* creates magnetic field, and the magnetic force is exerted on the plunger 8*a* in the magnetic field. The plunger 8*a* upwardly projects from the solenoid 8*b*, and pushes the rear portion of the key 1*a*/1*b* so as to give rise to the key motion.

The key sensors 7 are of the type radiating light beams across the trajectories of the front portions of the black and white keys 1*a*/1*b*. In other words, the key sensors 7 are implemented by non-contact optical sensors. The key sensors 7 are arrayed on the key bed 102 in the lateral direction, and are operative to convert current key positions on the trajectories to analog key position signals yxa. Since the key trajectories between the rest positions and the end positions are fallen within the cross sections of the light beams, it is possible continuously to express the current key positions between the rest positions and the end positions in the key position signals yxa. The current key position is equivalent to the stroke from the rest position. In this instance, the end positions are spaced from the corresponding rest positions by 10 millimeters. Accordingly, the current key position has a value varied from zero to 10 in millimeter.

The key position signals yxa are supplied to the recording controller 12 in the recording mode and to the motion controller 11 in the playback mode. While the electronic system 300 is serving as the recorder 301, the recording controller 12 analyzes the pieces of key data expressed by the key position signals yxa so as to determine the key motion, supplies the pieces of music data, which express the performance, to the post data processor 13, and the post data processor 13 encodes the pieces of normalized music data in the formats defined in the MIDI protocols. In the normalization process, the post data processor 13 eliminates noise components due to the individualities of the acoustic piano 100 and individuality of key sensors 7 from the pieces of music data.

On the other hand, while the electronic system 300 is serving as the automatic player 302, the preliminary data processor 10 analyzes the music data codes so as to determine the reference key velocity, reference trajectories for the black keys 1*a* and white keys 1*b* to be moved, and the motion controller 11 compares the current key positions and current key velocity, which is calculated on the basis of the pieces of key data, with target key positions on the reference trajectories and target key velocity to see whether or not the black keys 1*a* and white keys 1*b* are exactly traveling on the reference trajectories. If the black keys 1*a* and white keys 1*b* are deviated from the reference trajectories, the motion controller 11 varies the mean current or duty ratio of the driving pulse signal u so as to force the black keys 1*a* and white keys 1*b* timely to catch up the next target key position on the reference trajectories. The black/white keys 1*a*/1*b* travelling on the reference trajectories give the hammer velocity expressed in the music data codes to the hammers 3. Thus, the key position signals yxa are used in a servo control on the solenoid-operated key actuators 6. In this instance, the solenoid-operated key actuators 6, key sensors 7 and motion controller 11 as a whole constitute a servo-control loop.

The current key velocity is determinable through the differentiation on a function expressing a series of current key positions. In a practical use, two reference points are determined on each of the key trajectories, and the current key velocity is given as a mean velocity in millimeter/second.

Figure 3:
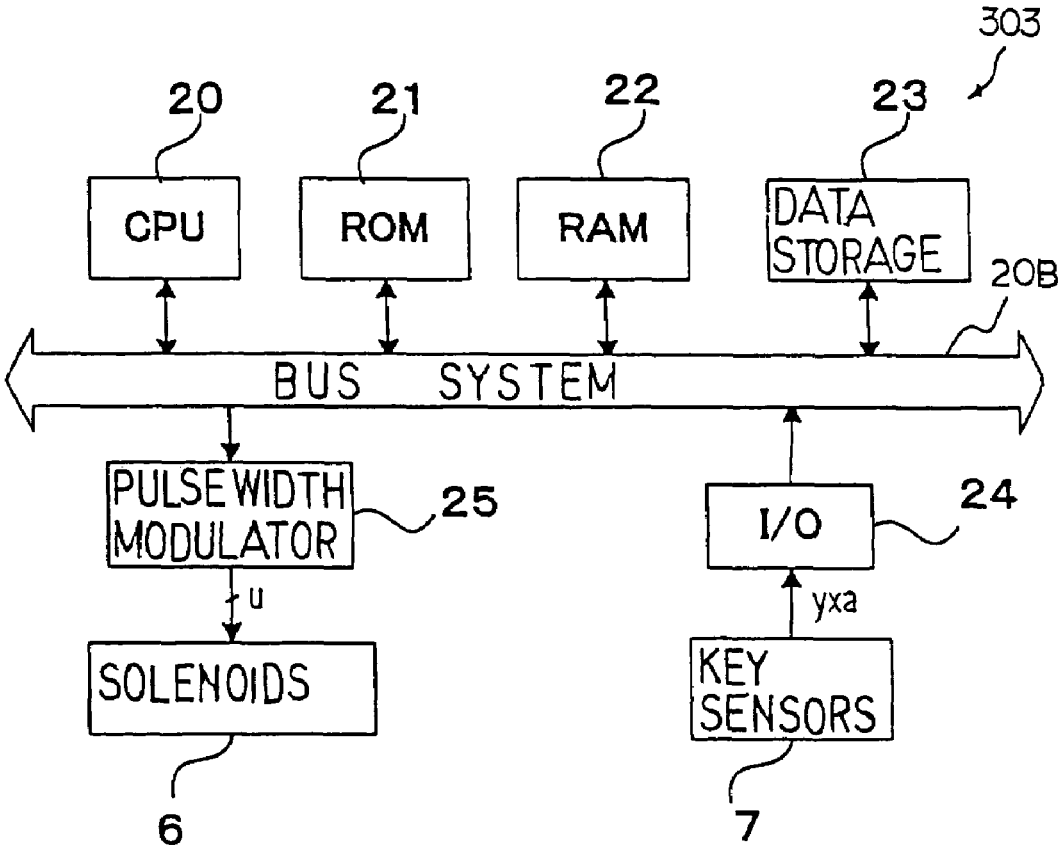
FIG. 3 is a block diagram showing the system configuration of a data processing unit incorporated in the automatic player musical instrument.

Turning to FIG. 3 of the drawings, the data processing unit 303 includes a central processing unit 20, which is abbreviated as "CPU", a read only memory 21, which is abbreviated as "ROM", a random access memory 22, which is abbreviated as "RAM", a data storage 23, an interface 24, which is abbreviated as "I/O", a pulse width modulator 25 and shared bus system 20B. The central processing unit 20, read only memory 21, random access memory 22, data storage 23, interface 24 and pulse width modulator 25 are connected to the shared bus system 20B so that the central processing unit 20 is communicable with the read only memory 21, random access memory 22, data storage 23, interface 24 and pulse width modulator 25 through the shared bus system 20B.

A microprocessor may serve as the central processing unit 20. A computer program, which includes a main routine program and subroutine programs, and parameter tables are stored in the read only memory 21 together with the velocity conversion table for fingered keys, velocity conversion table for solenoid-actuated keys, a reference table and a timing table for tone generation, and the random access memory 22 serves as a working memory. The random access memory 22 offers a temporary data storage to the central processing unit 20, and the playback table is prepared in the random access memory 22 through data transfer from the data storage 23. The timing table for tone generation expresses a relation between the hammer velocity and the timing at which the strings 4 are struck with the hammers 3.

The velocity conversion table for solenoid-actuated keys and velocity conversion table for fingered keys are hereinafter described with reference to figures 4A and 4B. The velocity conversion table for solenoid-actuated keys and velocity conversion table for fingered keys are respectively designated by reference numerals 30 and 31. The hammer velocity is corresponding to the "velocity" defined in the MIDI protocols, and the target value of "velocity" is assumed to be varied from zero to 80 for the sake of simplicity.

Pieces of key data and pieces of hammer data were gathered in the master automatic player piano, and were analyzed as follows. A human operator depressed a key of the master automatic player piano. The key sensor supplied pieces of key data representative of the current key position, and the hammer sensor supplied pieces of hammer data representative of the current hammer position or hammer motion, which the depressed key gave rise to. The data processor calculated the reference key velocity on the basis of the pieces of key data around the reference key point, and further calculated the hammer velocity on the basis of the pieces of hammer data immediately before the strike at the string. The calculation results were indicative of a measured value of reference key velocity and a measured value of hammer velocity, and the measured value of reference key velocity was correlated with the measured value of hammer velocity.

The human operator repeated the above-described experiment at different values of force for each of the black and white keys. Upon completion of the experiment, a set of measured values of hammer velocity was correlated with a set of measured values of reference key velocity, and the relation between the measured values of reference key velocity and the measured values of hammer velocity was memorized in the velocity conversion table 31 for fingered keys.

Subsequently, the human operator instructed the electronic system of the master automatic player piano to drive the black and white keys at a reference value of reference key velocity, and gathered the pieces of key data and pieces of hammer data through the key sensors and hammer, sensors for the black and white keys. The data processor calculated the reference key velocity on the basis of the pieces of key data around the reference key points, and further calculated the hammer velocity on the basis of the pieces of hammer data immediately before the strikes at the string. The calculation results were indicative of measured values of reference key velocity and measured values of hammer velocity. Thus, the measured values of reference key velocity were correlated with the measured values of hammer velocity through the experiment and calculation. The operator repeated the experiment at different reference values of reference key velocity, and the measured values of reference key velocity were correlated with the measured values of hammer velocity in the velocity conversion table 30 for solenoid-actuated keys.

Plots PL1 and PL2 stand for the relation between the hammer velocity and the reference key velocity stored in the velocity conversion table 30 for solenoid-actuated keys and velocity conversion table 31 for fingered keys, respectively. Comparing plots PL1 with plots PL2, it is understood that the black/white keys 1*a*/1*b*, which a human player depressed with his or her fingers, gave rise to the hammer motion higher in reference key velocity than the hammer motion given rise to by the solenoid-operated key actuators 6. For example, when the black/white key 1*a*/1*b* was moved at 0.2 ml/s, the solenoid-operated key actuator 6 gave rise to the hammer motion at 60 in MIDI code through the key motion, and the human player gave rise to the hammer motion at 70 in MIDI code through the same key motion.

Although the tables are stored in the read only memory 21 in the non-volatile manner in the electronic system 300, the tables may be stored in the non-volatile data storage 23 so as to be transferred to the random access memory 22 through a system initialization in the main routine program. While electric power is being supplied to the data processing unit 303, the central processing unit 20 reiterates the main routine program in order to communicate with users, and the main routine program selectively branches into subroutine programs depending upon user's instruction.

Turning back to FIG. 3, the data storage 23 has a huge data holding capacity, and sets of music data codes, which represent pieces of music, are stored therein. The sets of music data codes are prepared through the performance on the keyboard 1 in the recording mode, and are processed in order to reenact the performance in the playback mode. Otherwise, the sets of music data codes are loaded into the data storage 23 through a portable information storage medium or a communication network. In this instance, the data storage 23 is implemented by a hard disk driver unit. The data storage 23 can retain the tables without any electric power.

The interface 24 includes analog-to-digital converters, and the key sensors 7 are connected to the analog-to-digital converters. The key position signals yxa are supplied to the analog-to-digital converters, and are converted to digital key position signals. The central processing unit 20 periodically fetches the pieces of key data expressed by the digital key position signals, and memorizes the pieces of key data in the random access memory 22. A software timer gives the timing at which the key data is fetched to the central processing unit 20. The central processing unit 20 analyzes the series of key data so as to determine the current key status for each of the black and white keys 1*a*/1*b*.

The pulse width modulator 25 is responsive to a control signal, which is supplied from the central processing unit 20, so as to adjust the driving pulse signal u to a target value of mean current or a given duty ratio, and supplies the driving signal u to the solenoid 8*b* for the black/white key 1*a*/1*b* to be actuated.

Although other system components such as a switches, indicators and display window are not shown in FIG. 3, these system components are connected to the interface 24, and the user communicates with the central processing unit 20 through those system components. However, any hammer sensor is not incorporated in the electronic system 300 so that the automatic player piano according to the present invention is categorized in the hammer sensor-less automatic player piano.

Behavior in Recording Mode

Figure 5:
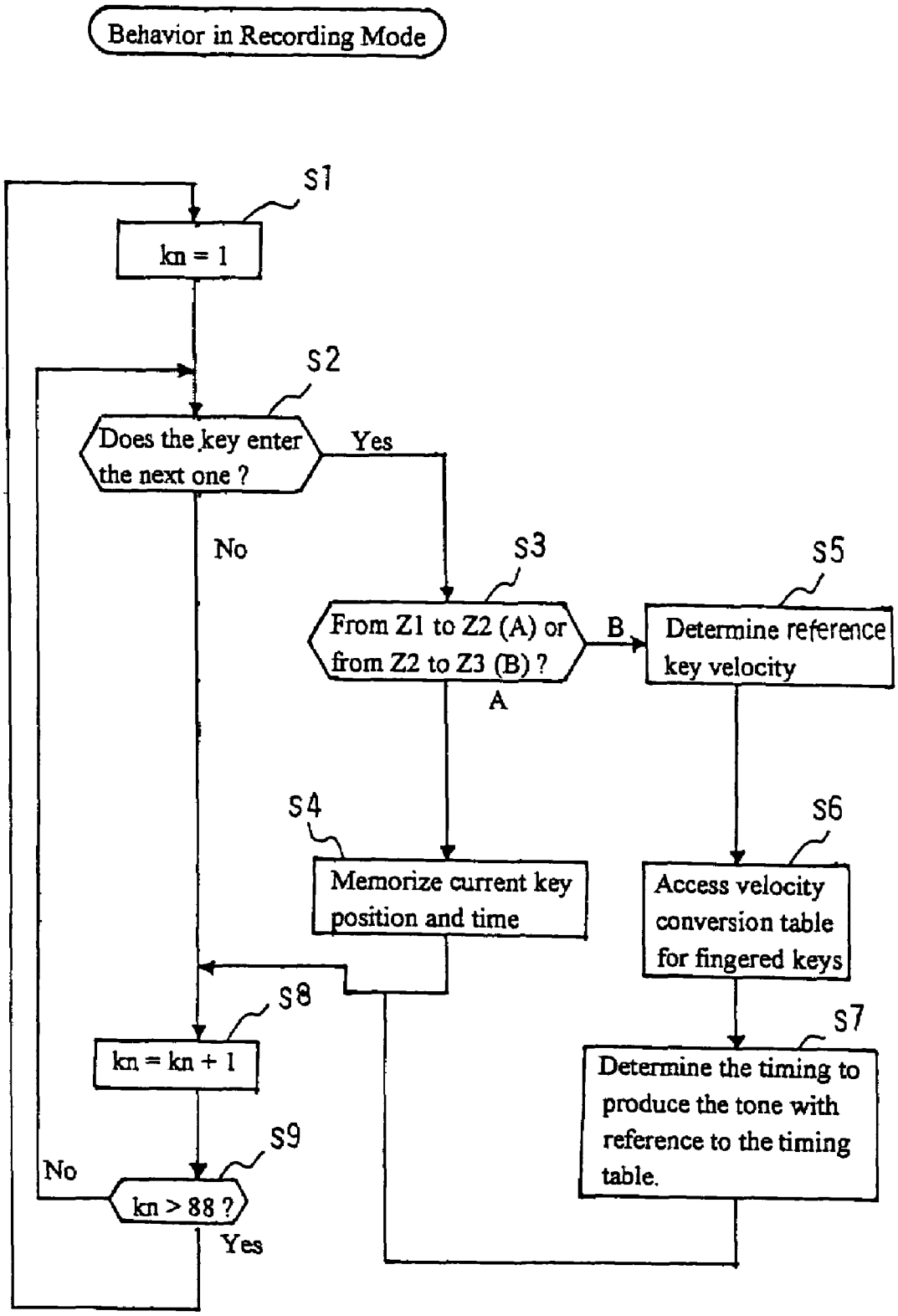
FIG. 5 is a flowchart showing a subroutine program for recording.

When a user instructs the electronic system 300 to record his or her performance, the main routine program branches to a subroutine program for the recording, and the subroutine program runs on the central processing unit 20 for recording the performance. FIG. 5 shows the outline of the subroutine program for the recording.

Firstly, the central processing unit 20 sets an index register kn for "1" as by step S1. The index register kn is indicative of the key number assigned to the black key 1*a* or white key 1*b*, and the value stored therein is varied between 1 and 88. The key number "1" is assigned to leftmost white key 1*b*. The central processing unit 20 periodically reiterates the loop consisting of steps S1 to S9 in the recording mode so as to find black and white keys 1*a*/1*b* moved by the human player.

Figure 6:
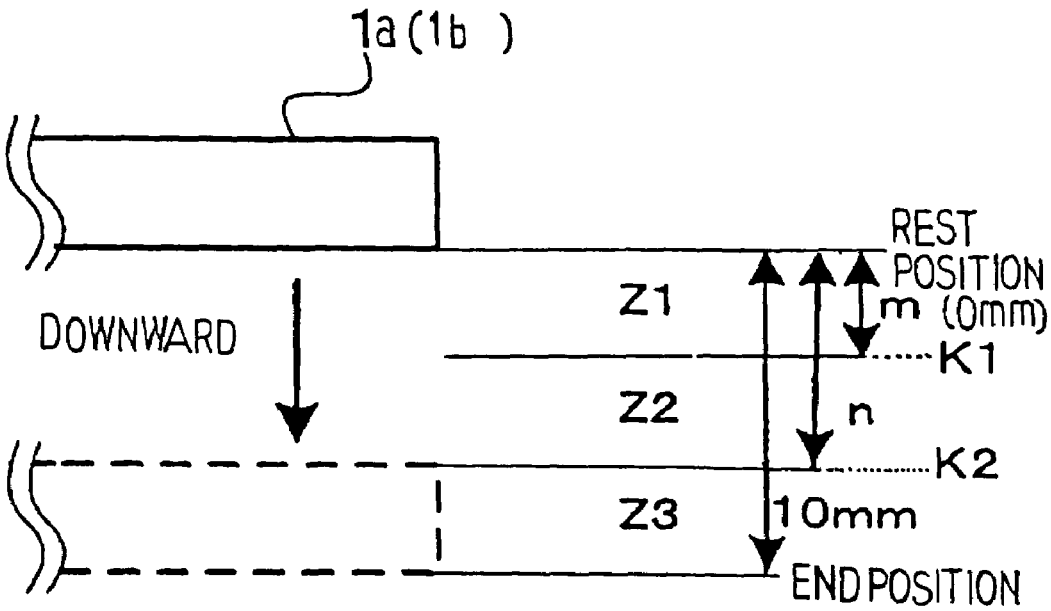
FIG. 6 is a view showing zones defined along a trajectory of a key.

The central processing unit 20 compares the latest value of current key position with the previous value of current key position and the thresholds K1 and K2 to see whether or not the white key 1*b* proceeds to the next zone Z2 or Z3 as by step S2. In this instance, each of the key trajectories is divided into three zones Z1, Z2 and Z3 as shown in FIG. 6. The zone Z1 is from the rest position to the keystroke "m", and the threshold K1 stands for the boundary between the zone Z1 and the next zone Z2. The next zone Z2 is from the key-stroke m to the keystroke n, and the threshold K2 is indicative of the boundary between the zone Z3 and the next zone Z3. When the black and white keys 1*a*/1*b* enter the zones Z3 over the thresholds K2, the central processing unit 20 decides that the hammers 3 start the free rotation through the escape. The zone Z3 is from the keystroke n to the end position, i.e., the keystroke of 10 millimeters. Thus, the series of pieces of key data permits the central processing unit 20 to discriminate different sorts of key motion from one another.

Turning back to FIG. 5, if the leftmost white key 1*b* still stays in the zone Z1, Z2 or Z3 from the previous execution to the present execution, the answer is given negative "No". With the negative answer "No", the central processing unit 20 increments the index register kn by one as by step S8, and compares the value of the index register kn with the greatest value 88 to see whether or not all the black and white keys 1*a*/1*b* have been investigated as by step S9. While the central processing unit 20 is investigating the black/white keys 1*a*/1*b* between the leftmost white key 1*b* and the rightmost white key 1*b*, the answer at step S9 is given negative "No", and the central processing unit 20 returns to step S2.

When the central processing unit 20 investigated the eighty-eighth key 1*b*, the answer at step S9 is changed to affirmative, and the central processing unit 20 returns to step S1. The central processing unit 20 resets the index register kn to 1, and investigates the leftmost white key 1*b*, again.

Thus, the central processing unit 20 reiterates the loop consisting of steps S1, S2, S8 and S9, and looks for a black key/white key 1*a*/1*b* entering the next zone Z2 or Z3 across the threshold K1 or K2.

The central processing unit 20 is assumed to find a black/white key 1*a*/1*b* entering the next zone Z2 or Z3. The answer at step S2 is changed to the affirmative "Yes", and the central processing unit 20 checks the comparison result to see whether the black/white key 1*a*/1*b* proceeds from the zone Z1 to the zone Z2 or from the zone Z2 to the zone Z3 as by step S3. When the black/white key 1*a*/1*b* entered the zone Z2, the central processing unit 20 adopts course "A", and checks the software timer for determining the time so as to memorize the time together with the key position in the random access memory 22 as by step S4. Upon completion of the jobs at step S4, the central processing unit 20 proceeds to step S8. Thus, the central processing unit 20 returns to the loop. The current key position and time are used in step S2 in the next execution.

If, on the other hand, the black/white key 1*a*/1*b* entered the next zone Z3, the central processing unit 20 acknowledges that the black/white key 1*a*/1*b* have given rise to the free rotation of the hammer 3, and adopts course "B". The course "B" leads the central processing unit 20 to step S5, and the central processing unit 20 determines the reference key velocity. The difference in length, i.e., (n−m) is divided by the difference between the transit time at threshold K1 and the transit time at threshold K2, and the quotient represents the reference key velocity.

Subsequently, the central processing unit 20 accesses the velocity conversion table for fingered keys 31, and reads out a target value of hammer velocity corresponding to the measured value of reference key velocity as by step S6. Upon completion of the jobs at step S6, the central processing unit 20 proceeds to step S7, and accesses the timing table for tone generation so as to determine the timing to produce the acoustic piano tone. Pieces of timing data are correlated with the values of hammer velocity in the timing table for tone generation. The timing data is indicative of a lapse of time from the transit at K2 to the initiation of tone generation, and the unit is millisecond.

Figures 7, 8:
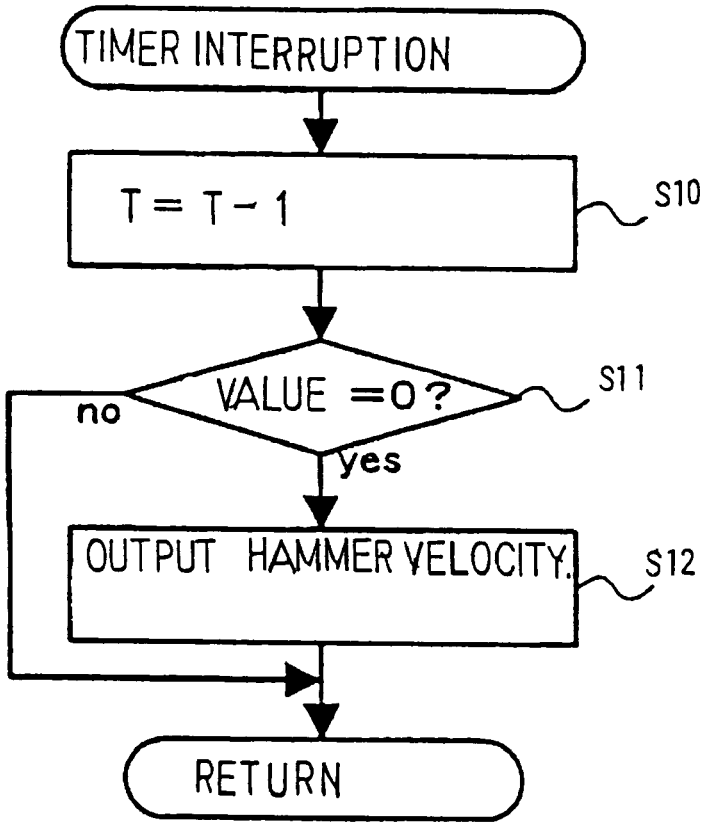
FIG. 7 is a view showing a timing table for tone generation.
FIG. 8 is a flowchart showing a count-down subroutine program.

The central processing unit 20 makes pieces of hammer data representative of the values of hammer velocity Velo 1, Velo 2, Velo 3, . . . . Velo 16 paired with the pieces of timing data T1, T2, T3, . . . and T16 as shown in FIG. 7. The values of hammer velocity Velo 1, Velo 2, Velo 3, . . . and Velo 16 are corresponding to the pieces of velocity data defined in the MIDI protocols. The pairs of hammer velocity Velo 1 to Velo 16 and pieces of timing data T1 to T16 are memorized in the random access memory 22 together with the key number assigned the depressed keys 1*a*/1*b* and other data. It is possible to concurrently produce sixteen pieces of paired data at the maximum.

Upon completion of the memorization, the central processing unit 20 returns to the loop consisting of steps S1, S2, S8 and S9. Thus, the central processing unit 20 reiterates the loop consisting of steps S1 to S9 so as to obtain the pieces of music data.

Though not shown in FIG. 5, the subroutine program for the recording further has steps for the released keys and steps for producing the music data codes on the basis of the key number, piece of hammer data and piece of timing data.

As described hereinbefore, the central processing unit 20 repeatedly executes the program sequence shown in FIG. 5, and produces the pieces of music data representative of the performance on the keyboard 1. The pieces of music data are normalized, and are encoded to the MIDI music data codes. After the performance on the keyboard 1 is terminated at a certain tone, the user instructs the central processing unit 20 to transfer a set of MIDI music data codes to the data storage 23. The central processing unit 20 adds the status byte representative of the end of the performance to the MIDI music data codes representative of the tones produced by the user, and transfers the set of MIDI music data codes to the data storage 23, an external musical instrument through a MIDI cable or an external data storage through a communication network.

Thus, the central processing unit 20 estimates the hammer velocity by using the velocity conversion table 31 for fingered keys, and produces the MIDI music data codes representative of the performance.

Count-down Subroutine

The timing to generate the acoustic tones is controlled through a count-down subroutine shown in FIG. 8. A timer interruption takes place at intervals of 1 millisecond, and the main routine program or subroutine program enters the count-down subroutine program at every timer interruption.

While the main routine program or subroutine program is running on the central processing unit 20, the timer interruption is assumed to takes place. The main routine program or subroutine program branches to the count-down subroutine. The central processing unit 20 firstly accesses the random access memory 22, and reads out each of the pieces of time data T1, T2, . . . , which "T" stands for in FIG. 8. The central processing unit 22 decrements the values of the pieces of time data T by one as by step S10.

Subsequently, the central processing unit 20 checks the pieces of timing data T to see whether or not any one of the values reaches zero as by step S11. If the answer is given negative "no", the central processing unit 20 immediately returns to the main routine program or subroutine program.

On the other hand, when the central processing unit 20 finds one of the pieces of timing data T is indicative of zero, the answer at step S11 is given affirmative "yes". Then, the central processing unit 20 supplies the associated piece of hammer data to a suitable destination as by step S12. If the user wishes to produce electronic tones through another electronic musical instrument (not shown), the central processing unit 20 outputs a music data code, in which the piece of hammer data is stored, through the interface 24 to the electronic musical instrument (not shown). If, on the other hand, the electronic system 300 further includes an electronic tone generator (not shown) and a sound system (not shown), the central processing unit 20 supplies the music data code to the electronic tone generator (not shown), and the electronic tone generator (not shown) starts to compose an audio signal. Another candidate of the destination is the data storage 23. The music data codes may be stored in the data storage 23 together with or without duration data codes.

Upon completion of the jobs at step S12, the central processing unit 20 returns to the main routine program or subroutine program. Thus, the central processing unit 20 controls the timing to produce the tones with the pieces of timing data.

Playback Table

In the playback, the solenoid-operated key actuators 6 give rise to the hammer motion through the key motion. Although target values of hammer velocity is memorized in the music data codes expressing the note-on events, the solenoid-operated key actuators 6 can not directly move the hammers 3, but exert the force on the black and white keys 1*a*/1*b* so as to give rise to the key motion. The force is varied with the mean current of the driving pulse signal u. The larger the force is, the larger the key velocity is.

Figure 9:
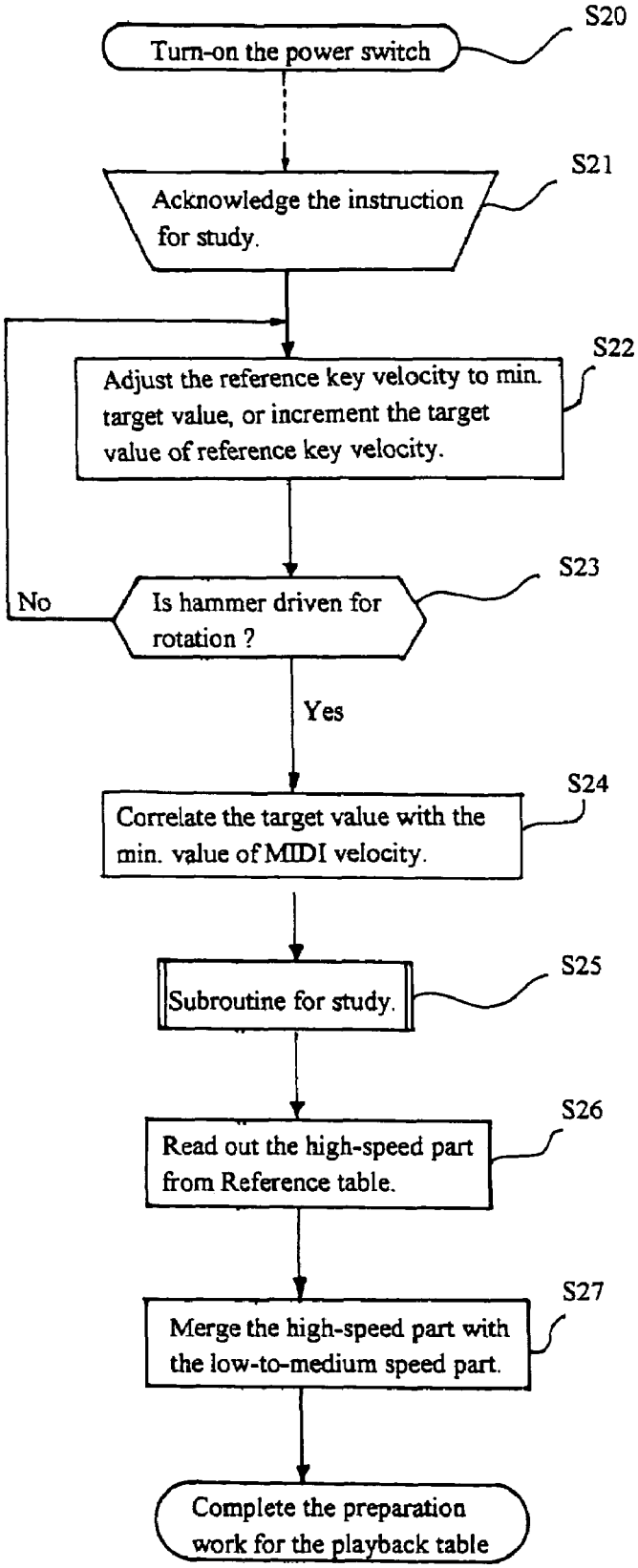
FIG. 9 is a flowchart showing a subroutine program for preparation of a playback table.

The data processing unit 303 is expected to control the hammer motion with the driving pulse signal through the key motion. The data processing unit 303 determines a target value of reference key velocity through the access to the playback table, and controls the key motion through the servo-control loop with the driving pulse signal. The playback table is prepared through the study, and FIG. 9 shows a subroutine program for preparation of the playback table. The playback table may be prepared during the installation work at user's home or after a repairing work on the automatic player piano. Although the central processing unit 20 repeats steps S22, S23, S24, S25, S26 and S27 eighty-eight times for the eighty-eight black and white keys 1*a*/1*b*, description is once made on one of the black/white keys 1*a*/1*b* for the sake of simplicity.

Assuming now that a user turns on the power switch as by step S20, the main routine program starts to run on the central processing unit 20, and firstly initializes the electronic system 300. If the user instructs the central processing unit 20 to prepare the playback table, the central processing unit 20 acknowledges the user's instruction as by step S21, and determines a critical value of the mean current at which the hammer is driven for the free rotation as by steps S22 and S23. The user gives the instruction at step S21 to the central processing unit 20 when the workers complete a repairing work or a maintenance work on the automatic player piano.

In detail, the central processing unit 20 instructs the servo-control loop to adjust the black/white key 1*a*/1*b* to the minimum target value of reference key velocity. The pulse width modulator 25 starts to supply the driving pulse signal u to the solenoid 8*b* of the associated solenoid-operated key actuator 6, and the central processing unit 20 checks the piece of key data to see whether or not the black/white key 1*a*/1*b* exactly travels on the reference trajectory. The servo-control loop keeps, increases or decreases the mean current of the driving pulse signal u in order to make the black/white key 1*a*/1*b* pass the reference point at the minimum target value.

If the plunger 8*b* exerts the force, which is large enough to make the hammer 3 escape from the jack 2*a*, on the rear portion of the black/white key 1*a*/1*b*, the hammer 3 starts the free rotation, and the string 4 is struck with the hammer 3. The string 4 generates the acoustic piano tone. If, on the other hand, the force is too small, the hammer 3 can not escape from the jack 2*a*, and any acoustic piano tone is not generated. The central processing unit 20 presumes the string 4 to be struck with the hammer 3 on the basis of the key position. As will be described in conjunction with FIG. 6, if the pieces of key data exhibit that the black/white key 1*a*/1*b* exceeds the threshold K2, the positive answer "Yes" is given to the central processing unit 20. If, on the other hand, not, the negative answer "No" is given to the central processing unit 20. Since the driving pulse signal u has been adjusted to the minimum value of the mean current, the force is so small that the hammer 3 can not escape from the jack 2*a*. This results in the negative answer "No" at step S23. The method for the presumption has been already known to the skilled persons.

With the negative answer "No" at step S23, the central processing unit 20 returns to step S22, and instructs the servo-control loop to make the black/white key 1*a*/1*b* pass the reference point at the next target value of reference key velocity. The next target value is greater than the minimum target value. The pulse width modulator 25 increments, decrements and keeps the mean current of the driving signal so that the servo-control loop makes the black/white key 1*a*/1*b* pass the reference key point at the next target value of reference key velocity. Thus, the central processing unit 20 reiterates the loop consisting of steps S22 and S23 until the answer at step S23 is changed to affirmative.

The hammer 3 is assumed to escape from the jack 2*a* at a certain target value of reference key velocity. The answer at step S23 is changed to affirmative. With the positive answer "Yes", the central processing unit 20 proceeds to step S24, and decides that the certain target value is the critical value of reference key velocity. The minimum value of velocity defined in the MIDI message has been already known. Then, the central processing unit 20 correlates the critical target value of reference key velocity with the minimum value of velocity, which is corresponding to the minimum value of the hammer velocity.

Figure 10:
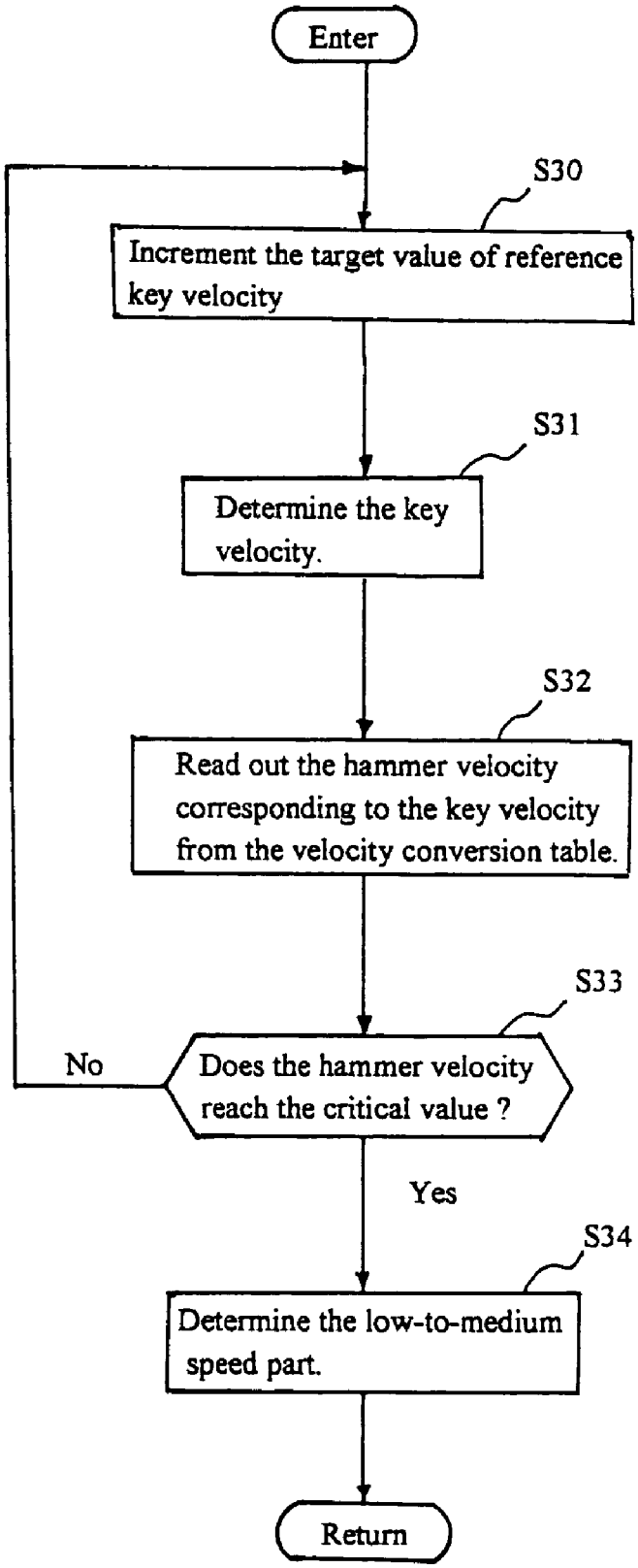
FIG. 10 is a flowchart showing a subroutine program for study.

Upon completion of the job at step S24, the central processing unit 20 enters a subroutine program for the study as by step S25. The sequence of the subroutine program is shown in FIG. 10, and is hereinafter described in detail.

Upon entry into the subroutine program for the study, the central processing unit 20 increments the target value of reference key velocity as by step S30. In the first execution at step S25, the reference key velocity is increased from the certain target value, which is corresponding to the critical value, to the next value. It is not necessary that the increment is corresponding to the value of the highest resolution. The hammer velocity may be stepwise increased five times between the minimum value and the critical value F (see FIG. 11). When the value of the hammer velocity is found between one of the five points and another of the five points in the playback, the central processing unit 20 determines the mean current through the interpolation. Thus, the interpolation is desirable, because the load on the central processing unit 20 in the study is reduced.

The servo-control loop controls the black/white key 1*a*/1*b* to pass the reference key point at the next value. The pulse width modulator 25 increases, decreases and keeps the driving pulse signal u, and supplies the driving pulse signal u to the solenoid 8*b*. The plunger 8*a* upwardly pushes the rear portion of the black/white key 1*a*/1*b*, and gives rise to the key motion. The force is sequentially transmitted from the black/white key 1*a*/1*b* through the action unit 2 to the hammer 3, and the string 4 is struck with the hammer 3 at the end of the free rotation.

In this situation, the key sensor 7 reports the key motion to the central processing unit 20 through the key position signal yxa, and the central processing unit 20 determines the reference key velocity as by step S31. With the measured value of reference key velocity, the central processing unit 20 accesses the velocity conversion table 30 for solenoid-actuated keys, and reads out the corresponding value of the hammer velocity from the velocity conversion table 30 for solenoid-actuated keys as by step S32. The corresponding value is interpreted as a target value of hammer velocity. The central processing unit 20 correlates the target value of hammer velocity with the measured value of reference key velocity, and stores them in the random access memory 22. The jobs at step S32 will be hereinlater described in more detail.

Subsequently, the central processing unit 20 compares the target value of hammer velocity with the critical value F to see whether or not the study work reaches the boundary between a low-and-medium speed part and a high-speed part as by step S33. While the answer at step S33 is given negative "No", the central processing unit 20 reiterates the loop consisting of steps S30 to S33, and accumulates the target values of hammer velocity correlated with the measured values of reference key velocity in the random access memory 22.

When the central processing unit 20 finds the target value of hammer velocity approximately equal to the critical value F, the central processing unit 20 completes the "study", and determines the low-to-medium speed part as by step S34, and stores the relation in the low-to-medium speed part in the random access memory 22. Thereafter, the central processing unit 20 returns to the subroutine program shown in FIG. 9, and proceeds to step S26.

Turning back to FIG. 9, the central processing unit 20 accesses the reference table at step S26, and reads out a high-speed part H from the reference table. The reference table is hereinafter described in more detail.

The manufacturer prepares the reference table through experiments on the master automatic player piano before the delivery to the user. The manufacturer instructs the data processing unit of the master automatic player piano to make the black/white key pass the reference point at a reference value of reference key velocity through the servo-control loop. The driving signal is supplied from the pulse width modulator to the solenoid-operated key actuators, and the mean current is increased, decreased and maintained in order to make the black/white keys pass the reference key points at the reference value. The actuated black/white keys give rise to the hammer motion. The hammer sensors supply the hammer position signal to the data processing unit, and the data processing unit determines the hammer velocity on the basis of the pieces of hammer data. The data processing unit correlates the measured value of the hammer velocity with the reference value of reference key velocity.

Even if the solenoid-operated key actuators 6 make the key motion unstable, the hammer velocity is directly determined on the basis of the pieces of hammer data so that the relation in the reference table is reliable. The experiment is repeated at different reference values of the reference key velocity, and the relation between the reference values of reference key velocity and the measured values of the hammer velocity is memorized in the reference table. Thus, the reference table is prepared through the experiments, and is duplicated into the suitable memory such as the read only memory 21.

The central processing unit 20 transcribes the high-speed part H from the read only memory 21 to the random access memory 22, and merges the high-speed part H with the low-to-medium speed part ML as by step S27. Thus, the central processing unit 20 completes plots PL11 (see FIG. 11) for one of the eighty-eight keys 1*a*/1*b*.

Although the low-to-medium speed part is tailor-made, the high-speed part is merely transcribed from the reference table to the playback table, and the reference table is ready-made for the products of the hammer sensor-less automatic player piano. It may be rare that the rightmost value on the low-to-medium speed part ML is equal to the leftmost value of the high-speed part H. This means that the low-to-medium speed part ML has to be connected to the high-speed part H through a suitable merging technique.

There are some candidates. The first candidate is the interpolation. Values are interpolated between the rightmost value "P" (see FIG. 11) and the leftmost value of the high-speed part H. The second candidate is to prepare several reference tables different in pattern. The central processing unit 20 selects the optimum reference table from them, and connects the low-to-medium speed part ML to the high-speed part H read out from the optimum table. The third candidate is to modify the reference table. The modification may be carried out through a parallel displacement of the high-speed part H or rotation of the high-speed part H about the greatest value.

Figure 11:
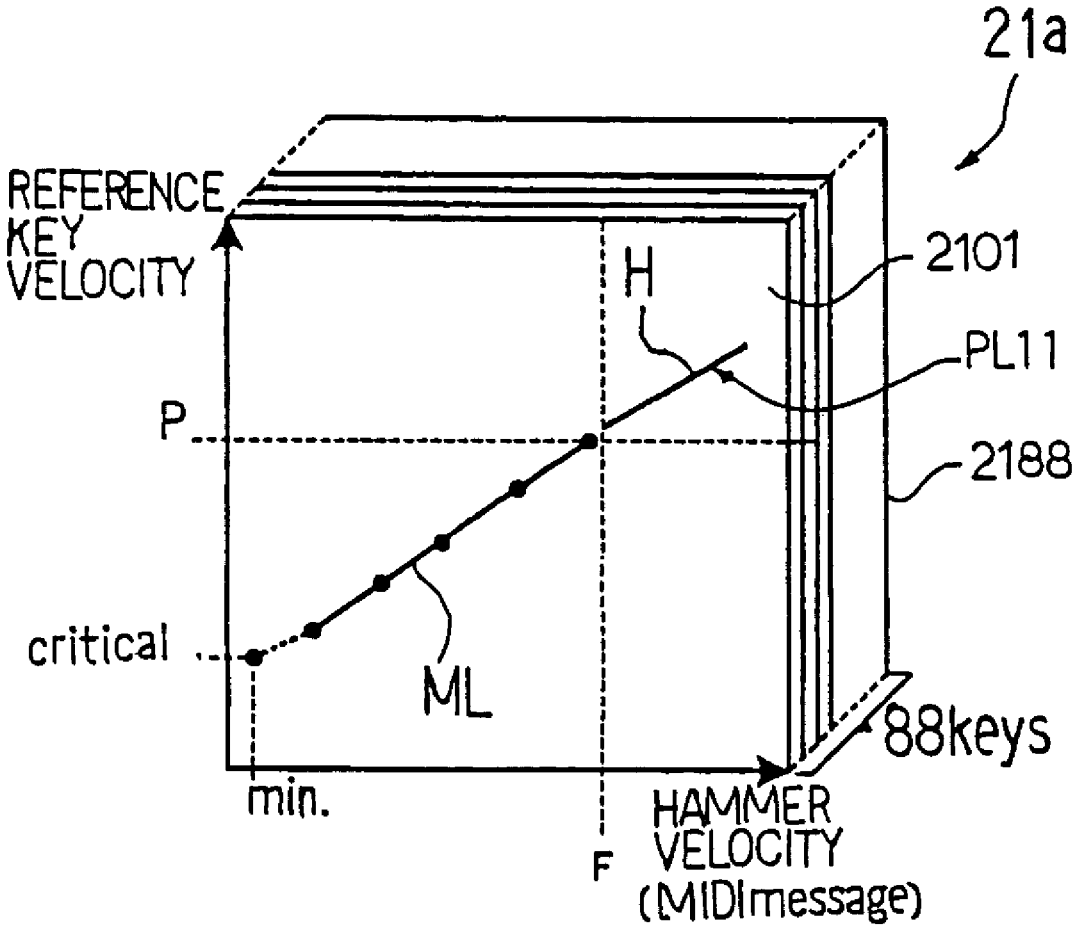
FIG. 11 is a schematic view showing the structure of the playback table.

The central processing unit 20 repeats the above-described sequence eighty-eight times, and completes the playback table 21*a* for the eighty-eight keys 1*a*/1*b* as shown in FIG. 11. The reference table has been prepared for each of the eighty-eight black/white key 1*a*/1*b* so that the central processing unit 20 selectively accesses the eighty-eight reference tables at step S26.

As will be understood, the playback table 21*a* is partially prepared through the study, and is merged between the relation determined through the study and the transcription of the part H from the reference table. The reference table is prepared through the experiments on the master automatic player piano, and the influence of unstable key motion is taken into account. In other words, the servo-control loop is expected to give rise to the hammer motion in the relation between the reference key velocity and the hammer velocity. Thus, the playback table according to the present invention makes the original hammer motion exactly reproduced in the playback mode.

Computer Program at Step S32

Figure 12:
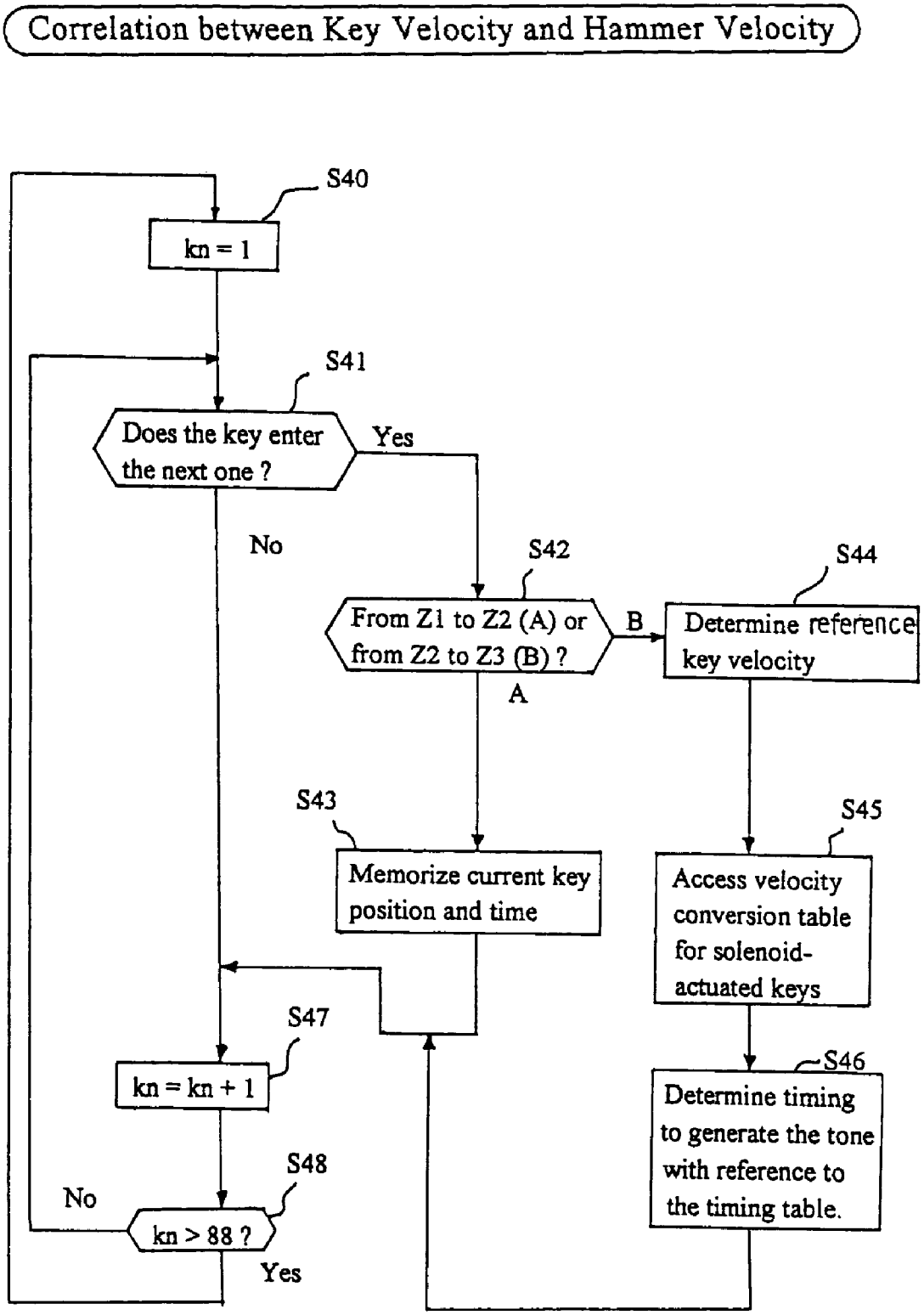
FIG. 12 is a flowchart showing an instruction sequence expressing a part of the subroutine program for study.

FIG. 12 shows a part of the subroutine program corresponding to step S32. When the central processing unit 20 enters the subroutine program for study, the central processing unit 20 writes "1" in the index register kn as by step S40. In the first execution, the central processing unit 20 investigates the low-and-medium speed part ML of the leftmost white key 1*b*. The key number in the index register kn is incremented, and the investigation is successively focused on the other black and white keys 1*a*/1*b* toward the right side. In other words, the loop consisting of steps 41 to 48 is repeated eighty-eight times. However, description is focused on the loop once for the leftmost white key 1*b* for the sake of simplicity. Since the key number is stored in the index register kn, the key number is also labeled with "kn" in the following description.

The central processing unit 20 reads out the latest two values of the key data for the leftmost key 1*b* from the random access memory 22, and compares the latest value of current key position with the previous value of current key position and the thresholds K1 and K2 to see whether or not the white key 1*b* proceeds to the next zone Z2 or Z3 as by step S41. If the white key 1*b* still stays in the zone Z1, Z2 or Z3 from the previous execution to the present execution, the answer is given negative "No". With the negative answer "No", the central processing unit 20 increments the key number kn by one as by step S47, and compares the key number kn with 88 to see whether or not the key number kn is greater than 88 as by step S48. While the central processing unit 20 is investigating the leftmost white key 1*b* and the right-most white key 1*b*, the answer at step S48 is given negative "No", and the central processing unit 20 returns to step S41.

When the central processing unit investigated the eighty-eighth key 1*b*, the answer at step S48 is changed to affirmative, and the central processing unit 20 returns to step S40, and resets the index register kn to 1.

Thus, the central processing unit 20 reiterates the loop consisting of steps S40, S47 and S48, and looks for a black key/white key 1*a*/1*b* entering the next zone Z2 or Z3 across the threshold K1 or K2.

The central processing unit 20 is assumed to find that the white key 1*b* enters the next zone Z2 or Z3. The answer at step S41 is changed to the affirmative "Yes", and the central processing unit 20 checks the comparison result to see whether the white key 1*b* proceeds from the zone Z1 to the zone Z2 or from the zone Z2 to the zone Z3 as by step S42. When the white key 1*b* entered the zone Z2, the central processing unit 20 adopts course "A", and checks the software timer for determining the present time so as to memorize the present time together with the latest value of the key position in the random access memory 22 as by step S43. Upon completion of the jobs at step S43, the central processing unit 20 proceeds to step S47, and returns to the loop. The latest value of the current key position is used in steps S41 and S44 in the next execution.

If, on the other hand, the white key 1*b* entered the next zone Z3, the central processing unit 20 acknowledges that the black/white key 1*a*/1*b* have given rise to the free rotation of the hammer 3, and adopts course "B". The course "B" leads the central processing unit 20 to step S44, and the central processing unit 20 determines the reference key velocity.

In detail, the central processing unit 20 determines the latest value of the current key position and the present time, and respectively subtracts the latest value of current key position and the present time from the previous value and previous time, which were memorized at step S43 in the previous execution. The difference between the values of current key position is divided by the difference between the previous time and the present time, and determines the mean value of the key velocity.

Subsequently, the central processing unit 20 accesses the velocity conversion table 30 for solenoid-actuated keys, and reads out a value of hammer velocity corresponding to the mean value of the key velocity as by step S45. Thus, the measured value of reference key velocity is correlated with the read-out target value of hammer velocity.

Upon completion of the jobs at step S45, the central processing unit 20 proceeds to step S46, and accesses the timing table for tone generation so as to determine the timing to generate the tone. Thereafter, the central processing unit 20 returns to the loop. Thus, the central processing unit 20 reiterates the loop consisting of steps S40 to S48 so as to correlate the key velocity with the hammer velocity with reference to the velocity conversion table 30 for the solenoid-actuated keys.

As will be understood, the two velocity conversion tables 30 and 31 are selectively used depending upon the origin of the force exerted on the black and white keys 1*a*/1*b*. This results in the playback table exactly defined for the playback and a set of music data codes exactly expressing the performance on the keyboard 1.

Subroutine Program for Playback

Assuming now that a user instructs the electronic system 300 to reenact his or her performance, the central processing unit 20 transfers the set of music data codes representative of the performance from the data storage 23 to the random access memory 22, and sequentially reads out the music data codes from the random access memory 23. The music data codes express note-on events, note-off events, lapse of time between the previous note-on event/previous note-off event and the note-on event/note-off event and other messages.

When the central processing unit 20 receives the music data code expressing the note-on event, the central processing unit 20 determines the black/white key 1*a*/1*b* to be actuated, timing at which the black/white key 1*a*/1*b* starts toward the end position, a target value of the reference key velocity and the reference trajectory for the black/white key 1*a*/1*b*. The function is expressed as "preliminary data processor" in FIG. 2. If the black/white key 1*a*/1*b* exactly travels on the reference trajectory, the string 4 is struck with the hammer 3 at the target value of the hammer velocity so that the acoustic piano tone is produced at the target loudness. The method for determining the reference key velocity and reference trajectory is disclosed in Japanese Patent Application laid-open No. Hei 7-175472 as referred to hereinbefore. Japanese Patent Application laid-open No. Hei. 7-175472 was published on the basis of Japanese Patent Application No. Hei. 5-344241, the Priority Right of which had been claimed in U.S. Ser. No. 08/356,871, and U.S. Ser. No. 08/673,016 was the continuation application of the U.S. Patent Application. The Continuation Application was patented, and U.S. Pat. No. 5,652,399 was assigned to the Continuation Application. In the following description, the black/white keys 1*a*/1*b* are assumed to take uniform motion on the reference trajectory.

When the central processing unit 20 determines the reference trajectory through the function as the preliminary data processor 10, the servo-control loop starts to control the black/white key 1*a*/1*b* pass the reference key point at the target value of reference key velocity.

When the driving pulse signal u flows through the solenoid 8*b*, the solenoid 8*b* creates the magnetic field, and the magnetic force, which is proportional to the value of mean current, is exerted on the plunger 8*a*. The plunger 8*a* upwardly projects from the solenoid 8*b*, and pushes the rear portion of the black/white key 1*a*/1*b*. The front portion of the black/white key 1*a*/1*b* is slightly sunk, and the key sensor 7 reports the current key position to the data processor 20 through the key position signal yxa.

The central processing unit 20 compares the target value of the key position on the reference key trajectory with the measured value of the current key position to see whether or not the black/white key 1*a*/1*b* exactly travels on the reference trajectory. If the answer is given affirmative, the central processing unit 20 requests the pulse width modulator 25 to keep the driving pulse signal u at the value of the mean current. If, on the other hand, the answer is given negative, the central processing unit 20 determines a new value of the mean current to be required for bringing the black/white key 1*a*/1*b* to the next value of the key position on the reference trajectory, and informs the pulse width modulator 25 of the new value of mean current. Thus, the central processing unit 20, pulse width modulator 25, solenoid-operated key actuator 6 and key sensor 7 serve as the servo control loop.

While the black/white key 1*a*/1*b* is traveling on the reference key trajectory, the servo-control loop requests the pulse width modulator 25 to increase, decrease and keep the mean current of driving pulse signal u as described hereinbefore so that the black/white key 1*a*/1*b* passes the reference key point at the target value of reference key trajectory.

The central processing unit 20 repeats the above-described control sequence for the black/white keys 1*a*/1*b* to be actuated so that the acoustic piano tones are sequentially produced along the music passage without any fingering of a human pianist.

Figure 13:
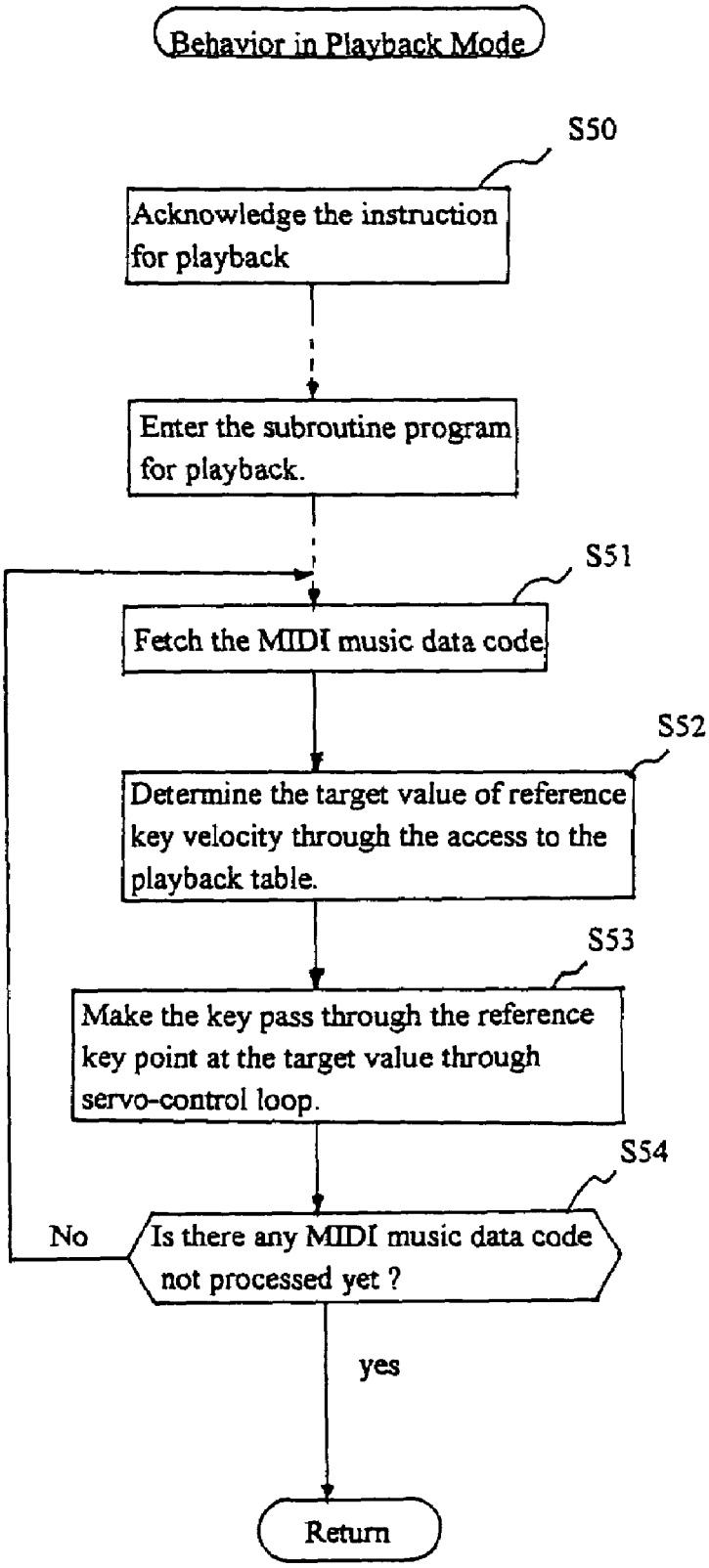
FIG. 13 is a flowchart showing a subroutine program for playback.

FIG. 13 shows a subroutine program for the playback. While the central processing unit 20 is reiterating the main routine program, the user is assumed to instruct the automatic player 302 to reenact a performance already recorded in the form of MIDI music data codes. The central processing unit 20 acknowledges the instruction for the playback as by step S50. Then, the main routine program branches to the subroutine program for playback, and the central processing unit 20 transfers the set of MIDI music data codes from the data storage 23 to the random access memory 22.

The central processing unit 20 fetches the MIDI music data code to be firstly processed from the random access memory 22, and specifies the black/white key 1*a*/1*b* to be moved, the hammer velocity or loudness and the timing to produce the tone as by step S51.

Subsequently, the central processing unit 20 accesses a data block 2101 to 2188 of the playback table 21*a* corresponding to the black/white key 1*a*/1*b* to be moved, and reads out a target value of the reference key velocity corresponding to the target value of hammer velocity indicative of the target loudness as by step S52. The central processing unit 20 determines a reference trajectory for the black/white key 1*a*/1*b*. The pulse width modulator 25 starts to supply the driving pulse signal u to the solenoid-operated key actuator 6 associated with the black/white key 1*a*/1*b* to be moved.

The driving pulse signal u causes the plunger 8*a* to project so as to give rise to the key motion. While the plunger 8*a* is projecting upwardly, the key sensor 7 reports the current key position to the central processing unit 20, and the central processing unit 20 compares the current key position with the target key position on the reference trajectory to see whether or not the black/white key 1*a*/1*b* exactly travels on the reference trajectory. If the answer is given affirmative, the central processing unit 20 instructs the pulse width modulator 25 to keep the mean current of the driving pulse signal u at the present value. On the other hand, if the answer is given negative, the central processing unit 20 instructs the pulse width modulator 25 to increment or decrement the mean current, and the pulse width modulator 25 varies the mean current of the driving pulse signal u. Thus, the servo-control loop forces the black/white key 1*a*/1*b* to pass the reference key point at the target value of reference key velocity as by step S53.

Subsequently, the central processing unit 20 checks the random access memory 22 to see whether or not a MIDI music data code representative of the event is still left therein as by step S54. When the central processing unit 20 finds the MIDI music data code in the random access memory, the answer is given negative "No", and the central processing unit 20 returns to step S51. Thus, the central processing unit 20 reiterates the loop consisting of steps S51 to S54 for processing the MIDI music data codes. If the central processing unit 20 does not find any MIDI music data code, the answer at step S54 is given affirmative, and the central processing unit 20 returns to the main routine program.

As will be appreciated from the foregoing description, the two sorts of velocity conversion tables 30 and 31 have been prepared for the recording and study, and are stored in the data processing unit 303 before delivery to the user. While the recorder 301 is recording the performance on the keyboard 1, the data processing unit 303 determines the loudness of tones or hammer velocity through the access to the velocity conversion table 31 for fingered keys. Since the data conversion table 31 for fingered keys expresses the relation between the hammer velocity and the reference key velocity determined through the experiment on the master automatic player piano, the data processing unit 303 can exactly determine the hammer motion with reference to the velocity conversion table 31 for fingered keys so that the performance is recorded as a set of music data codes.

On the other hand, while the data processing unit 303 is preparing the playback table 21*a*, the solenoid-operated key actuators 8 sequentially give rise to the key motion, and the data processing unit 303 determines the hammer velocity through the access to the velocity conversion table 30 for solenoid-actuated keys. Since the data conversion table 30 for solenoid-operated keys expresses the relation between the hammer velocity and the reference key velocity for the keys actuated by the solenoid-operated key actuators in the master automatic player piano, the unstable key motion is taken into account so that the data processing unit 303 exactly estimates the hammer velocity on the basis of the key velocity. Thus, the automatic player piano according to the present invention exactly records and reenacts the performance through the selectively access to the two velocity conversion tables 30 and 31.

Although the particular embodiment of the present invention has been shown and described, it will be apparent to those skilled in the art that various changes and modifications may be made without departing from the spirit and scope of the present invention.

Figure 4A:
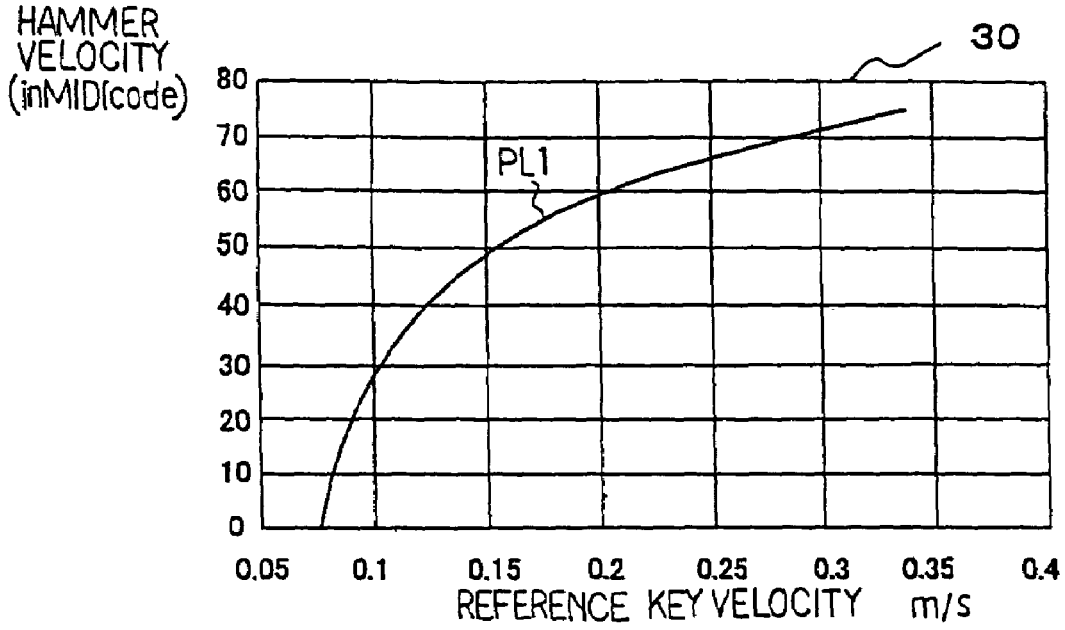
FIG. 4A is a graph showing the relation between a hammer velocity and a key velocity stored in a velocity conversion table for solenoid-actuated keys.
Figure 4B:
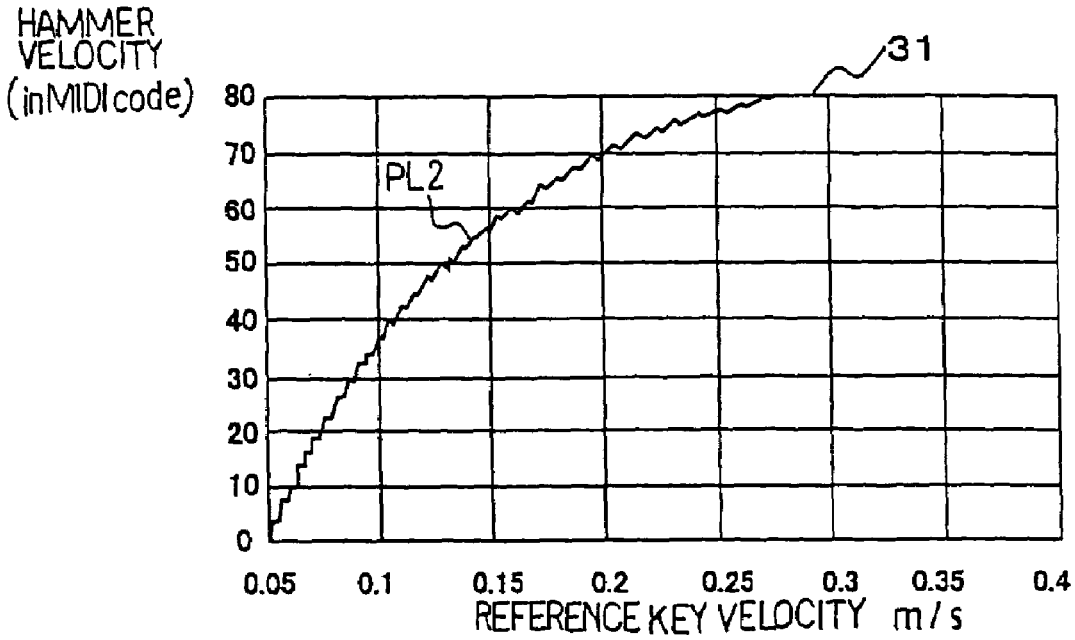
FIG. 4B is a graph showing the relation between the hammer velocity and the key velocity stored in a velocity conversion table for fingered keys.

For example, the relations between the key velocity and hammer velocity shown in FIGS. 4A and 4B do not set any limit to the technical scope of the present invention. A set of velocity conversion tables for fingered keys and/or a set of velocity conversion tables for solenoid-actuated keys may be prepared for different sorts of key motion. Each of the black and white keys 1*a*/1*b* may be accompanied with a velocity conversion table for fingered keys and a velocity conversion table for solenoid-operated keys.

In the above-described embodiment, the loudness of tones is expressed as the hammer velocity. However, the loudness may be expressed as motion of another component part such as, for example, the jack 2*a*. Thus, the hammer and hammer velocity do not set any limit to the technical scope of the present invention.

The non-contact optical sensors may be replaced with another sort of sensor such as, for example, a magnetic sensor or a potentiometer. The other sort of sensor may convert velocity or acceleration of the black/white keys 1*a*/1*b* to key velocity signals or key acceleration signals. The position, velocity and acceleration are converted to one another through the differentiation and integration. The functions 12/13 of recorder 301 and functions 10/11 of automatic player may be realized by means of wired logic circuits.

A flexible disk driver unit, a floppy disk (trademark) driver unit, a compact disk driver unit, a photo-electro-magnetic disk driver unit, a ZIP disk driver unit and a DVD (Digital Versatile Disk) driver unit are available for the data storage 23. In case where the tables are stored in the read only memory 21, a RAM board is available for the data storage 23.

Another automatic player according to the present invention may have an equation or a set of equations expressing the relation between the hammer velocity and the key velocity.

The read only memory 21 may be implemented by electrically erasable programmable read only memory. In this instance, the read only memory 21 can partially serve as a working memory.

The reference tables may be replaced with only one reference table or some reference tables. The some reference tables may be assigned to different pitched parts. In case where only one reference table is shared among all the black and white keys 1*a*/1*b*, only one high-speed part may be accessed for all the black and white keys 1*a*/1*b*. In this instance, only a small amount of memory space is occupied by the playback tables so that the manufacturer can reduce the data holding capacity of the random access memory 22.

In the above-described embodiment, the keys are assumed to take the uniform motion. The black/white keys 1*a*/1*b* may be assumed to take a uniformly accelerated motion. Even if the black/white keys are assumed to take the uniformly accelerated motion, the reference trajectories are presumable for the keys to be moved, and the solenoid-operated key actuators give rise to the key motion with reference to the playback table.

The acceleration and/or displacement may be taken into account in the servo-control. In this instance, the servo-control is carried out on selected one of ones of the position, velocity and acceleration.

The MIDI protocols do not set any limit to the technical scope of the present invention. Even if an automatic player musical instrument is designed on the basis of another set of musical protocols, the present invention is applicable to the automatic player musical instrument in so far as the loudness of tones are to be controlled on the basis of certain behavior of component parts not directly monitored.

The automatic player piano does not set any limit to the technical scope of the present invention. The present invention is applicable to any sort of automatic player musical instrument fabricated on the basis of another acoustic or hybrid musical instrument such as, for example, a mute piano, a keyboard for practical use, a harpsichord or a celesta. The mute piano is a hybrid keyboard musical instrument, and a hammer stopper and an electronic tone generator are installed in an acoustic piano. While a pianist is performing a piece of music on the mute piano without any acoustic piano tones, the electronic system determines the measured values of reference key velocity on the basis of the pieces of key data, accesses the velocity conversion table 31 for fingered keys so as to determine the target values of hammer velocity or target loudness, and supplies the music data codes to an electronic tone generator. The electronic tone generator produces an audio signal on the basis of the music data codes, and the audio signal is converted to electronic tones through a headphone.

In case where the present invention is applied to the mute piano, the central processing unit may also periodically execute the count-down subroutine, and transfer the MIDI music data code, in which the piece of hammer data Velo is stored, to an electronic tone generator when the associated piece of timing data reaches zero.

The computer program may be downloaded from an external program source through a communication network or read out from a portable information storage medium such as, for example, a floppy disk or a compact disk.

The pulse width modulator 25 does not set any limit to the technical scope of the present invention. A voltage regulator may be used for adjusting the potential level of a driving signal to a target value.

The usage in the study does not set any limit to the technical scope of the present invention. The velocity conversion table 30 for solenoid-actuated keys may be accessed in any situation where the solenoid-operated key actuators 8 give rise to the key motion. For example, while the central processing unit 20 is working for the playback, the central processing unit 20 may access the velocity conversion table 30 for solenoid-operated keys instead of the playback table.

Similarly, the velocity conversion table 31 for fingered keys may be accessed for a performance through another electronic musical instrument. The music data codes are transferred through a MIDI cable or a public communication network to the electronic musical instrument in a real time fashion, and the electronic musical instrument produces electronic tones on the basis of the music data codes. Thus, the usage in recording mode does not set any limit to the technical scope of the present invention.

The master automatic player piano does not set any limit to the technical scope of the present invention. Hammer sensors may be temporarily installed in the automatic player piano so as to carry out the experiments.

The hammer velocity does not set any limit to the technical scope of the present invention. Another master automatic player piano may equip pressure sensors instead of the hammer sensor, because the loudness of tones are also proportional to the force exerted on the strings 4. Otherwise, the sound pressure may be directly measured by a suitable sensor. Thus, the hammer motion may be expressed as the pressure exerted on the strings 4 or sound pressure.

The key motion may be also expressed as another sort of physical quantity. For this reason, the velocity conversion tables do not set any limit to the technical scope of the present invention.

The component parts of the automatic player piano are correlated with claim languages as follows. The black keys 1*a* and white keys 1*b* serve as "plural manipulators", and the action units 2 and hammers 3 as a whole constitute "plural link works". The strings 4 serve as a "tone generator". The key sensors 7 are corresponding to "plural sensors", and solenoid-operated key actuators 6 serve as "plural actuators". The key position signals express "the motion of said plural manipulators". The velocity conversion table 31 for fingered keys and velocity conversion table 30 for solenoid-actuated keys are corresponding to a "converter" and "another converter", respectively.

What is claimed is:

1. An automatic player musical instrument for producing tones, comprising:

plural manipulators selectively moved for specifying the pitch of tones to be produced;

plural link works respectively connected to said plural manipulators, and respectively having certain links, the motion of which are given rise to through the motion of said plural manipulators;

a tone generator energized with said plural manipulators through said plural link works so as to produce said tones at said pitch specified through said plural manipulators; and an electronic system including plural sensors monitoring said plural manipulators so as to produce signals representative of said motion of said plural manipulators, plural actuators energized with driving signals so as to give rise to said motion of said plural manipulators and a data processing unit connected to said plural sensors and said plural actuators, having a converter expressing a relation between said motion of said plural manipulators and said motion of said certain links determined under the condition that said plural manipulators are moved by a human player and another converter expressing another relation between said motion of said plural manipulators and said motion of said certain links determined under the condition that said plural manipulators are moved by means of said plural actuators and estimating said motion of said certain links and said motion of said plural manipulators on the basis of pieces of data expressed by said signals and pieces of music data representative of said motion of said certain links selectively with assistance of said converter and said another converter depending upon an origin of force exerted on said plural manipulators.

2. The automatic player musical instrument as set forth in claim 1, wherein said motion of said plural manipulators and said motion of said certain links are expressed as reference velocity at respective reference points on respective reference trajectories of said plural manipulators and velocity of said plural certain links.

3. The automatic player musical instrument as set forth in claim 2, wherein said velocity of said plural manipulators and said velocity of said plural certain links are determined on the basis of pieces of data measured by means of sensors monitoring said plural manipulators and said plural certain links.

4. The automatic player musical instrument as set forth in claim 3, wherein said sensors are installed in a master automatic player musical instrument corresponding to said automatic player musical instrument so that said plural manipulators and said plural certain links are also incorporated in said master automatic player musical instrument together with said sensors.

5. The automatic player musical instrument as set forth in claim 1, wherein said converter and said another converter are installed in said data processing unit in the form of a table so that values expressing said motion of said plural manipulators are correlated with values expressing said motion of said plural certain links in said table.

6. The automatic player musical instrument as set forth in claim 5, wherein said values expressing said motion of said plural manipulators and said values expressing said motion of said plural certain links are determined on the basis of pieces of data measured by means of sensors monitoring the plural manipulators and the plural certain links installed in a master automatic player musical instrument.

7. The automatic player musical instrument as set forth in claim 6, wherein said pieces of data express series of positions of said plural manipulators and series of positions of said plural certain links, and velocity of said plural manipulators and velocity of said plural certain links are determined so as to express said motion of said plural manipulators and said motion of said plural certain links.

8. The automatic player musical instrument as set forth in claim 1, wherein said converter is activated for determining said motion of said plural certain links while said electronic system is recording a performance on said plural manipulators by a human player.

9. The automatic player musical instrument as set forth in claim 8, wherein said motion of said plural certain links expresses loudness of said tones.

10. The automatic player musical instrument as set forth in claim 9, wherein said loudness is expressed as selected ones of said pieces of music data produced by said electronic system in the form of a music data code.

11. The automatic player musical instrument as set forth in claim 10, in which a format of said music data code is defined in MIDI (Musical Instrument Digital Interface) protocols.

12. The automatic player musical instrument as set forth in claim 1, wherein said another converter is activated for determining said motion of said plural certain links while said electronic system is preparing a playback table expressing a relation between said reference velocity and said motion of said plural certain links for reenacting a performance by means of said plural actuators.

13. The automatic player musical instrument as set forth in claim 12, wherein said motion of said plural certain links expresses loudness of said tones.

14. The automatic player musical instrument as set forth in claim 13, wherein said loudness is expressed as a piece of music data given to said electronic system in the form of a music data code.

15. The automatic player musical instrument as set forth in claim 14, wherein a format of said music data code is defined in MIDI (Musical Instrument Digital Interface) protocols.

16. The automatic player musical instrument as set forth in claim 1, wherein said plural manipulators and said plural certain links are keys and hammers both incorporated in an acoustic piano.

17. The automatic player musical instrument as set forth in claim 16, in which the motion of said hammers and the motion of said keys are expressed as velocity, and the velocity of said hammers expresses loudness of said tones.

18. An electronic system used for a musical instrument having plural manipulators, plural link works respectively connected to said plural manipulators and a tone generator energized with said plural manipulators through said plural link works for producing tones, comprising:

plural sensors monitoring said plural manipulators so as to produce signals representative of motion of said plural manipulators;

plural actuators energized with driving signals so as to give rise to said motion of said plural manipulators; and a data processing unit connected to said plural sensors and said plural actuators, having a converter expressing a relation between said motion of said plural manipulators and said motion of said certain links determined under the condition that said plural manipulators are moved by a human player and another converter expressing another relation between said motion of said plural manipulators and said motion of said certain links determined under the condition that said plural manipulators are moved by means of said plural actuators, and estimating said motion of said certain links and said motion of said plural manipulators on the basis of pieces of data expressed by said signals and pieces of music data representative of said motion of said certain links selectively with assistance of said converter and said another converter depending upon an origin of force exerted on said plural manipulators.

19. The electronic system as set forth in claim 18, wherein said converter and said another converter are installed in said data processing unit in the form of a table.

20. The electronic system as set forth in claim 19, wherein the table serving as said converter is accessed for determining velocity of said plural certain links expressing said motion while said electronic system is recording a performance on said plural manipulators, and the table serving as said another converter is accessed for determining velocity of said plural certain links expressing said motion while said electronic system is preparing a playback table expressing a relation between a reference velocity and said velocity of said plural certain links for reenacting a performance by means of said plural actuators.

* * * * *